US006237188B1

(12) United States Patent
Takemoto et al.

(10) Patent No.: US 6,237,188 B1
(45) Date of Patent: May 29, 2001

(54) SUCTION PORT BODY FOR VACUUM-CLEANER AND VACUUM-CLEANER HAVING THE SAME

(75) Inventors: Ritsuo Takemoto; Fumiki Mano, both of Hadano; Yosihiro Tutiya, Sunto-gun; You Torisawa, Hadano, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/367,944

(22) PCT Filed: Dec. 25, 1999

(86) PCT No.: PCT/JP98/05910

§ 371 Date: Aug. 23, 1999

§ 102(e) Date: Aug. 23, 1999

(87) PCT Pub. No.: WO99/33386

PCT Pub. Date: Jul. 8, 1999

(30) Foreign Application Priority Data

| | | |
|---|---|---|
| Dec. 26, 1997 | (JP) | 9-359096 |
| Dec. 26, 1997 | (JP) | 9-360246 |
| Jan. 30, 1998 | (JP) | 10-019918 |
| Feb. 5, 1998 | (JP) | 10-024309 |
| Feb. 10, 1998 | (JP) | 10-028186 |

(51) Int. Cl.[7] ..... A47L 5/14; A47L 9/08
(52) U.S. Cl. ..... 15/346; 15/327.3; 15/387
(58) Field of Search ..... 15/345, 346, 327.3, 15/387

(56) References Cited

U.S. PATENT DOCUMENTS

| | | | | |
|---|---|---|---|---|
| 787,388 | * | 4/1905 | Moorhead | 15/345 |
| 1,247,654 | | 11/1917 | Farnsworth | 15/346 |
| 2,181,487 | * | 11/1939 | Khuen-Kryk | 15/345 |
| 2,224,202 | * | 10/1940 | Smellie | 15/346 |
| 3,694,848 | | 10/1972 | Alcala | 15/346 |
| 4,393,536 | | 7/1983 | Tapp | 15/346 |
| 4,718,140 | | 1/1988 | Johnson | 15/330 |
| 4,884,315 | | 12/1989 | Ehnert | 15/346 |
| 5,048,275 | * | 9/1991 | Fassauer | 15/345 |
| 5,392,492 | * | 2/1995 | Fassauer | 15/327.3 |
| 5,457,848 | | 10/1995 | Miwa | 15/346 |
| 5,553,347 | * | 9/1996 | Inoue et al. | 15/327.3 |
| 5,562,779 | * | 10/1996 | Allaway et al. | 15/346 |

FOREIGN PATENT DOCUMENTS

| | | |
|---|---|---|
| 17646 | 9/1917 | (AU) . |
| 675674 | 10/1990 | (CH) . |
| 2 218 351 | 11/1973 | (DE) . |
| 36 19 300 A1 | 12/1987 | (DE) . |
| 41 40 630 C1 | 2/1993 | (DE) . |
| 42 29 030 A1 | 3/1994 | (DE) . |
| 2 138 280 | 10/1984 | (GB) . |
| 2 251 178 | 7/1992 | (GB) . |
| 39-36553 | 12/1964 | (JP) . |
| 51-154065 | 12/1976 | (JP) . |
| 57-145635 | 9/1982 | (JP) . |
| 61-2821 | 1/1986 | (JP) . |
| 3-162814 | 7/1991 | (JP) . |
| 4-64346 | 6/1992 | (JP) . |
| 5-253122 | 10/1993 | (JP) . |
| 7-37015 | 7/1995 | (JP) . |
| 7-327888 | 12/1995 | (JP) . |
| 8-103403 | 4/1996 | (JP) . |

* cited by examiner

*Primary Examiner*—Robert J. Warden, Sr.
*Assistant Examiner*—Theresa T. Snider
(74) *Attorney, Agent, or Firm*—Frishauf, Holtz, Goodman, Langer & Chick, P.C.

(57) ABSTRACT

A suction nozzle for a vacuum cleaner is designed so that exhaust from a motor blower in the body of the vacuum cleaner is provided into a suction port of the suction nozzle. The exhaust provided into the suction nozzle is prevented from being discharged to the atmosphere at the point where the suction nozzle meets the to-be-cleaned surface.

37 Claims, 21 Drawing Sheets

SUCTION PORT BODY FOR VACUUM-CLEANER AND VACUUM-CLEANER HAVING THE SAME

TECHNICAL FIELD

The present invention relates to a suction nozzle for an air-circulating vacuum cleaner and a vacuum cleaner furnished with the suction nozzle.

More specifically, the present invention relates to a suction nozzle for a vacuum cleaner designed so that an exhaust blast from a motor blower in the body of a cleaner is blown off into a suction port of the suction nozzle and circulated, whereby the exhaust blast ejected into the suction nozzle is prevented from being discharged to the outside from between the suction nozzle and a to-be-cleaned surface, and a vacuum cleaner furnished with the suction nozzle of this type.

BACKGROUND ART

An air-circulating vacuum cleaner is designed so that air is sucked into a suction port of a suction nozzle by operating a motor blower, the sucked air is run through a filter so that dust therein is seized, the air run through the filter and discharged from the motor blower is returned to the suction port, and the returned air is recovered through the suction port and circulated for cleaning. Thus, exhaust gas that contains dust, germs, etc. can scarcely be discharged to the outside, so that the cleaner has advantages in being more sanitary and less power-consuming.

In the circulating vacuum cleaner of this type, moreover, the circulated exhaust blast is blown against a floor surface so that dust on the floor surface can be flung up and sucked in. Thus, the dust collecting efficiency of this cleaner is high. Since the circulated exhaust blast is heated to high temperature, furthermore, harmful microorganisms, such as various germs, ticks, etc., in a dust chamber can be killed or wounded, so that better hygiene is ensured.

Vacuum cleaners of this type are disclosed in Jpn. UM Appln. KOKOKU Publication No. 39-36553, Jpn. Pat. Appln. KOKAI Publication No. 3-162814, etc.

According to these vacuum cleaners, an exhaust blast is blown off into the suction port of the suction nozzle, dust on a floor surface is flung up by the exhaust blast, and the exhaust blast, along with the dust, is sucked again into the motor blower. However, all the exhaust blast that is blown off into the suction port is not always sucked again into the motor blower in the aforesaid manner, and sometimes may leak out from between the suction nozzle and the floor surface. If the exhaust blast leaks out in this manner, the dust on the floor surface around the suction nozzle is blown away and scattered, so that the cleaning efficiency lowers inevitably. In the case where the floor surface to be cleaned is a smooth floor surface, such as a wooden floor surface, in particular, the exhaust blast easily leaks out through the gap between the suction nozzle and the floor surface. When the suction nozzle is lifted from the floor surface, moreover, the exhaust blast is liable to be blown off to the outside in the aforesaid manner.

Described in Jpn. Pat. Appln. KOKAI Publication No. 3-162814, etc., moreover, is a suction nozzle that has therein a cleaning rotor, which is rotated by utilizing the energy of the exhaust blast that is discharged from the motor blower and returned to the suction port. According to this suction nozzle, having the cleaning rotor therein, the cleaning rotor taps the floor surface to fling up dust thereon, so that the cleaning efficiency is high enough. Since the exhaust blast rotates in the suction port, the exhaust blast forms a turbulent flow in the suction port and easily leaks out through the gap between the suction nozzle and the floor surface.

When the suction nozzle having the cleaning rotor is lifted from the floor surface, furthermore, no resistance acts on the cleaning rotor, so that the cleaning rotor races at high speed, sometimes producing loud noises.

A brush or a rubber lip member that protrudes from the underside of a suction nozzle to prevent the exhaust blast from leaking to the outside is disclosed in, for example, Jpn. Pat. Appln. KOKAI Publication No. 61-2821, Jpn. UM Appln. KOKAI Publication No. 51-154065, etc.

Although the bristles of the brush and the projecting lip member have an effect to prevent the leakage of the exhaust blast to the outside, however, they may possibly push aside dust on a floor surface when the suction nozzle is moved on the floor surface, thus lowering the cleaning efficiency.

DISCLOSURE OF INVENTION

The present invention has been contrived in consideration of these circumstances, and provides a suction nozzle for vacuum cleaner designed so that an exhaust blast from a motor blower is returned to a suction port of the suction nozzle and circulated, whereby the exhaust blast can be prevented from leaking out from between the suction nozzle and a floor surface, and a vacuum cleaner furnished with the suction nozzle of this type.

According to the present invention, a nozzle hole is bored in a suction port of the aforesaid suction nozzle so that an exhaust blast can be blown off therefrom, and air leakage preventing means is provided for preventing the air blast from leaking out. Thus, the exhaust blast blown off through the nozzle hole can be sucked into a motor blower through the suction port without leaking out, so that cleaning can be carried out efficiently without blowing away and scattering dust around the suction nozzle.

The air leakage preventing means may include a nozzle hole, formed in part of inner wall vertical wall surfaces defining the inside space of the suction port and used to circulate and blow off an exhaust blast from the motor blower, and a screen portion formed over the whole area of an edge portion around the suction port except the region near the nozzle hole, whereby the gap between the suction nozzle and the to-be-cleaned surface is screened.

According to this arrangement, the screen portion prevents the exhaust blast blown off through the nozzle hole from leaking out. In this arrangement, moreover, no screen portion is formed in the region for the formation of the nozzle hole. If the suction nozzle is moved, therefore, dust on the to-be-cleaned surface is introduced and sucked into the suction port through that region, so that the cleaning efficiency cannot be lowered. If the exhaust blast is blown off through the nozzle hole, moreover, there is no possibility of the exhaust blast diffusing from the region near the nozzle hole, though ambient air may possibly be attracted to the jet of the exhaust blast to form a negative pressure in the region near the nozzle hole. Thus, there is no possibility of the exhaust blast leaking out from this region.

According to a preferred embodiment, the nozzle hole is formed in one of the inner wall vertical wall surfaces defining the inside space of the suction port so as to be directed toward the other inside wall surface, and the screen portion for screening the gap between the suction nozzle and the to-be-cleaned surface is formed over the whole area of the edge portion around the suction port except the region near the blow-off port. Thus, the exhaust blast from the nozzle hole can be securely prevented from leaking out.

According to another embodiment, moreover, the nozzle hole is provided on the side opposite from a connecting pipe mounting region for the connection of the suction nozzle to the cleaner body. Thus, no screen portion is formed in front of the suction nozzle, so that dust can be efficiently introduced into the suction port to expedite use as the suction nozzle is advanced.

Further, the air leakage preventing means includes a seal roller extending in a direction perpendicular to the moving direction of the suction nozzle and rotatable in contact with the to-be-cleaned surface, the seal roller being attached to the suction port so as substantially to cover the full width thereof.

In this arrangement, air discharged from the motor blower in the cleaner body is returned to the suction port, and air is sucked into the motor blower through the suction port, that is, air is circulated. Thus, dust on the to-be-cleaned surface can be sucked into the suction nozzle and cleared through the suction port that faces the to-be-cleaned surface as the air circulates.

During this cleaning operation, the suction nozzle is pushed and pulled as it moves along the to-be-cleaned surface. In this case, the seal roller rotates in contact with the to-be-cleaned surface in the moving direction of the suction nozzle, so that it can easily get over fine dust on the to-be-cleaned surface without pushing aside the dust. Thus, the seal roller never hinders the suction of the dust through the suction port. The seal roller, which is in contact with the to-be-cleaned surface, as mentioned before, serves as a windbreak wall at least in that portion of the gap between the to-be-cleaned surface and the bottom wall of the suction nozzle on the front side of the suction nozzle in the moving direction thereof. Thus, the seal roller can prevent some of the circulating air run through the suction port from leaking out forward in the moving direction of the suction nozzle through the gap, so that dust situated ahead of the suction nozzle in the moving direction thereof can be prevented from being blown away.

According to a preferred embodiment, moreover, the seal roller is provided with a plurality of ridges and grooves continuously extending in the axial direction on the outer periphery thereof.

Since the grooves are formed between the adjacent ridges in this arrangement, the seal roller scarcely runs on the fine dust on the to-be-cleaned surface as it gets over the dust, so that it can fulfill its function more easily as the windbreak wall. Since the seal roller catches the dust in its grooves as it rotates, moreover, it can easily rotate getting over the dust. Since the seal roller rotates with its ridges in contact with the to-be-cleaned surface, furthermore, it can rotate more easily with improved grip on the to-be-cleaned surface. Thus, the seal roller can be prevented from slipping on the to-be-cleaned surface as the suction nozzle moves.

According to another preferred embodiment, furthermore, the seal roller, which extends in the width direction of the suction nozzle, substantially covering the full width thereof, and can rotate in contact with the to-be-cleaned surface, is mounted on at least the front side of the suction port, out of the front and rear sides.

In this arrangement, the seal roller rotates in contact with the to-be-cleaned surface in the moving direction of the suction nozzle as the suction nozzle is moved for cleaning along the to-be-cleaned surface, so that it can easily get over fine dust on the to-be-cleaned surface without pushing aside the dust. Thus, the seal roller never hinders the suction of the dust through the suction port.

According to a preferred embodiment, moreover, the seal roller serves as a windbreak wall at least in that portion of the gap between the to-be-cleaned surface and the bottom wall of the suction nozzle on the front side of the suction nozzle in the moving direction thereof. Thus, the seal roller can prevent some of the circulating air run through the suction port from leaking out forward in the moving direction of the suction nozzle through the gap, so that cleaning can be carried out without blowing away dust that is situated ahead of the suction nozzle in the moving direction thereof.

In the suction nozzle that contains therein a cleaning rotor including cleaning blades against which the exhaust air from the motor blower is blown, furthermore, the air leakage preventing means includes a main suction-nozzle section having a suction port through which the cleaning blades are exposed to a bottom wall opposite to the to-be-cleaned surface, a main-section exhaust passage having a nozzle hole opposite to the cleaning blades and provided in the main suction nozzle section with the nozzle hole located on one side of the suction port in the width direction thereof, and a main-section suction passage provided in the main suction nozzle section and having a suction opening facing the nozzle hole across the suction port, the nozzle hole and the suction opening being arranged so that air blown off from the nozzle hole and brought to the suction opening via the cleaning blades flows along the to-be-cleaned surface.

In this arrangement, air blown off through the nozzle hole is blown against the cleaning blades of the cleaning rotor to rotate the cleaning rotor. Thus, the cleaning blades of the cleaning rotor can tap the to-be-cleaned surface to fling up dust so that the dust is sucked into the suction opening, whereby cleaning can be carried out efficiently. Further, the air blown off through the nozzle hole, along with the cleaning blades of the rotating cleaning rotor, flows along the to-be-cleaned surface, so that the flow of the ejected air gets into the suction opening without disturbance. Thus, the air can be securely prevented from leaking out of the suction nozzle.

According to a preferred embodiment, moreover, the width of a lower-stream-side bottom wall portion, situated on the lower-stream side with respect to the blowing direction of the air blown off from the nozzle hole, is greater than the width of an upper-stream-side bottom wall portion, situated on the upper-stream side with respect to the blowing direction with the suction port between the upper- and lower-stream-side bottom wall portions, the nozzle hole is located on the side of the upper-stream-side bottom wall portion, and the suction opening is located on the side of the lower-stream-side bottom wall portion.

Thus, the air resistance in the gap between the lower-stream-side bottom wall portion and the to-be-cleaned surface can be increased in proportion to this width, and the leakage of air to the outside can be effectively prevented by this substantial air resistance.

According to another preferred embodiment, furthermore, the nozzle hole is designed to project along the to-be-cleaned surface. Thus, the directivity of an air jet ejected through the nozzle hole is enhanced, so that the air can be securely prevented from blowing off to the outside of the suction port, and the leakage of the air to the outside can be prevented more effectively. Since the high-directivity jet runs against to the cleaning blades, moreover, the cleaning rotor can be rotated more effectively.

According to still another preferred embodiment, moreover, at least the lower part of the suction opening is substantially flush with the nozzle hole. Thus, the air blown off through the nozzle hole is sucked directly into the suction opening, so that the air can be prevented from blowing off to the outside of the suction port, and the leakage of the air to the outside can be prevented securely.

According to a further preferred embodiment, moreover, the main suction nozzle section contains therein a blast guide curved along the outer periphery of the cleaning rotor and defining the main-section exhaust air passage portion in conjunction with the inner surface of the main suction nozzle section, the guide dividing the main-section suction air passage and the main-section exhaust air passage.

Thus, the exhaust air from the motor blower can be guided to the nozzle hole through the exhaust air passage portion without running against the cleaning rotor. Accordingly, part of the exhaust blast can be prevented from branching off and reaching the suction opening without passing through the nozzle hole. Thus, the whole quantity of the exhaust blast can efficiently blow off through the nozzle hole, so that the cleaning efficiency can be improved.

In the case where the suction nozzle is cylindrical, moreover, the air leakage preventing means is formed as a connecting end portion having the suction port at the distal end thereof and having a proximal end communicating with the motor blower side, and includes a partition wall dividing a suction air passage, extending between the suction port and the connecting end portion and communicating with the suction side of the motor blower, and an exhaust air passage, communicating with the suction air passage at the suction port and communicating with the exhaust side of the motor blower, and which further comprises leaking means internally connecting the exhaust air passage to the outside thereof, thereby allowing some of the air flowing through the exhaust air passage to leak.

This cylindrical suction nozzle is a thin "pickax" as it is called, which is used to clean narrow areas such as gaps between furnishings. Naturally, the suction port at the distal end of this suction nozzle has a small diameter, so that the exhaust blast blown off through the suction port is liable to scatter ambient dust.

This suction nozzle has therein the suction air passage and the exhaust air passage that are divided from each other, and these air passages are internally connected by means of the suction port. In use, therefore, the air discharged from the motor blower can be returned to the suction port through the nozzle hole. The air returned to the suction port in the aforesaid manner is recovered by means of the suction air passage that communicates with the suction side of the motor blower, whereby the air can be recovered on the suction side of the motor blower. Thus, the air can be circulated covering the sucker and the cleaner body side, and dust on the to-be-cleaned surface can be sucked in through the suction port and cleared as the air circulates. In this cleaning operation, moreover, some of the air returned to the suction port is shunted to the outside of the exhaust air passage through the leaking means that communicates with the exhaust air passage. Therefore, the force of the air that is returned to the suction port can be reduced so that the pressure of the air is lower than suction pressure that acts on the suction port. Thus, some of the air returned to the suction port can be prevented from being blown off around the suction port without being sucked into the suction air passage.

According to a preferred embodiment, moreover, the suction port has a flat shape, so that narrow portions can be cleaned efficiently.

According to another preferred embodiment, furthermore, the leaking means is an exhaust opening for internally connecting the exhaust air passage to the atmosphere, the opening being located in a position at a distance from the suction port.

Thus, some of the air returned to the suction port is shunted to the outside (atmosphere) of the sucker through the exhaust opening that is internally connected in a position at a distance from the suction port, so that the force of the air returned to the suction port can be reduced to make the pressure of the air lower than suction pressure that acts on the suction port. Thus, some of the air returned to the suction port can be prevented from being blown off around the suction port without being sucked into the suction air passage.

According to another preferred embodiment, moreover, air leaking out through the exhaust opening is prevented from being blown against the to-be-cleaned surface. Thus, the air run through the exhaust opening cannot be blown against the to-be-cleaned surface with force, so that there is no possibility of dust on the to-be-cleaned surface being blown away by the exhaust air in the atmosphere and hindering the cleaning operation.

According to still another preferred embodiment, moreover, the leaking means is a bypass aperture provided in the partition wall and internally connecting the suction air passage and the exhaust air passage. When dust on the to-be-cleaned surface is sucked in through the suction port and cleared as the air circulates, therefore, some of the air returned to the suction port through the exhaust air passage is run into the suction port air passage through the bypass aperture in the partition wall that divides the two air passages. Accordingly, the force of the air returned to the suction port can be reduced to make the pressure of the air lower than suction pressure that acts on the suction port. Thus, some of the air returned to the suction port can be prevented from being blown off around the suction port without being sucked into the suction air passage.

In the suction nozzle that comprises a suction chamber having a suction opening in the base of the suction nozzle, a suction air passage communicating with the suction chamber, an exhaust air passage communicating with the suction chamber, and a nozzle hole for blowing an exhaust blast against the to-be-cleaned surface, furthermore, the air leakage preventing means includes an exhaust chamber for introducing the exhaust blast from the exhaust air passage and blowing the exhaust blast through the blow-off port, the exhaust chamber having in the bottom wall thereof an opening adapted to be closed by the to-be-cleaned surface when the suction nozzle is placed on the to-be-cleaned surface, the opening being designed so that the exhaust blast blown off therefrom cannot be blown against the to-be-cleaned surface.

When the suction nozzle is lifted, therefore, the opening that is closed by the floor surface is opened, so that the exhaust chamber is adjusted to the atmospheric pressure. Accordingly, the speed of ejection of the exhaust blast through the nozzle hole is low. Thus, dust on the floor surface can be prevented from being scattered by the exhaust blast that is blast blown off through the nozzle hole when the suction nozzle is lifted.

In the suction nozzle that comprises a suction chamber having a suction opening in the base of the suction nozzle, a turbine chamber provided in the suction nozzle and communicating with the suction chamber, a cleaning rotor located for rotation in the suction chamber, a turbine located for rotation in the turbine chamber and capable of rotating to rotate the cleaning rotor, a suction air passage communicating with the suction chamber, and an exhaust air passage communicating with the turbine chamber, the air the suction air passage and a dust chamber of the cleaner body being made to communicate with each other so that air in the suction chamber can be sucked into the dust chamber, the exhaust side of the cleaner body and the exhaust air passage being made to communicate with each other so that air discharged from the exhaust side can be run into the turbine chamber to rotate the turbine and that the air in the turbine chamber can be sucked into the suction chamber, whereby the air is circulated, moreover, the air leakage preventing means includes an opening in the base of the suction nozzle, adapted to be closed by the to-be-cleaned surface when the suction nozzle is placed on the to-be-cleaned surface, the opening and the exhaust air passage being made to communicate with each other, the opening being designed so that the exhaust blast blown off therefrom cannot be blown against the to-be-cleaned surface.

When the suction nozzle is lifted, therefore, the flow of air from the nozzle hole is so feeble that dust around the floor surface can be prevented from scattering. Further, the opening that is closed by the floor surface is opened to lower the pressure in the turbine chamber, so that the rotating speed of the turbine lowers, and the rotating speed of the cleaning rotor lowers. Although the cleaning rotor is exposed when the suction nozzle is lifted, therefore, the rotating speed of the cleaning rotor lowers, so that noises are reduced and safety is ensured.

In the suction nozzle that is a suction nozzle for vacuum cleaner comprising a suction chamber having a suction opening in the base of the suction nozzle, a turbine chamber provided in the suction nozzle and communicating with the suction chamber, a cleaning rotor located for rotation in the suction chamber, a turbine located for rotation in the turbine chamber and capable of rotating to rotate the cleaning rotor, a suction air passage communicating with the suction chamber, an exhaust air passage communicating with the turbine chamber, and a blow-off port for blowing off the exhaust air against the to-be-cleaned surface, the suction air passage and a dust chamber of the cleaner body being made to communicate with each other so that air in the suction chamber can be sucked into the dust chamber, the exhaust side of the cleaner body and the exhaust air passage being made to communicate with each other so that air discharged from the exhaust side can be run into the turbine chamber to rotate the turbine and that the air in the turbine chamber can be sucked into the suction chamber, whereby the air is circulated, furthermore, the air leakage preventing means includes an exhaust chamber for introducing the exhaust blast from the exhaust air passage and blowing the exhaust blast through the blow-off port, the exhaust chamber having in the bottom wall thereof an opening adapted to be closed by the to-be-cleaned surface when the suction nozzle is placed on the to-be-cleaned surface, the opening being designed so that the exhaust blast blown off therefrom cannot be blown against the to-be-cleaned surface.

When the suction nozzle is lifted, therefore, dust on the floor surface can be prevented from being scattered by the exhaust blast that is blast blown off through the nozzle hole, and the rotating speed of the cleaning rotor can be lowered.

According to a preferred embodiment, moreover, a swingable lid for closing the opening is provided so that it can be put on to close the opening when the suction nozzle is placed on the to-be-cleaned surface and taken off when the suction nozzle is separated from the to-be-cleaned surface.

When the suction nozzle body is placed on the to-be-cleaned surface, therefore, the opening can be securely closed by the lid. Further, the rotating speed of the turbine and the force of the exhaust blast blown off through the nozzle hole can be adjusted according to the type of the floor surface.

According to another preferred embodiment, furthermore, one of elements including the opening and the lid is surrounded by double ribs, and the other is surrounded by a rib interposed between the double ribs so that the other rib is inserted into the gap between the double ribs when the lid is put on and that the other rib is removed from between the double ribs when the lid is taken off.

In the case where the floor surface is the surface of a carpet or the like, for example, the airtightness of the exhaust chamber can be maintained by means of the double ribs even when the lid is left narrowly open. Thus, the speed of ejection of the exhaust blast blown off through the nozzle hole can be kept at a given speed, and the quantity of air that leaks out can be reduced, and the rotating speed of the turbine can be also kept at a given speed.

Another aspect of the present invention is a vacuum cleaner that comprises a cleaner body having a motor blower therein and a suction nozzle provided with the aforementioned air leakage preventing means. Thus, cleaning can be carried out efficiently and easily.

Further, this vacuum cleaner may be applied to an upright type such that the cleaner body and the suction nozzle are connected directly to each other or a canister type such that the cleaner body and the suction nozzle are connected by means of a flexible hose.

BEST MODE OF CARRYING OUT THE INVENTION

Embodiments of the present invention will now be described with reference to the drawings. FIGS. 1 to 10 show a first embodiment of the present invention such that the present invention is applied to a so-called upright vacuum cleaner in which a suction nozzle and a cleaner body are connected directly to each other.

Figure 1:
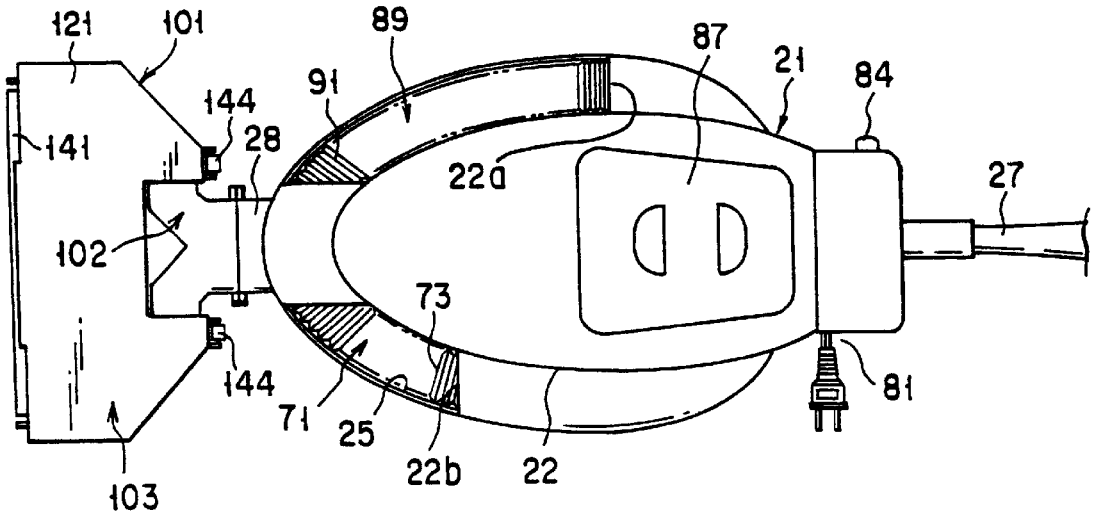
FIG. 1 is a plan view showing the general configuration of an upright air-circulating vacuum cleaner furnished with a suction nozzle according to a first embodiment of the present invention.
Figure 2:
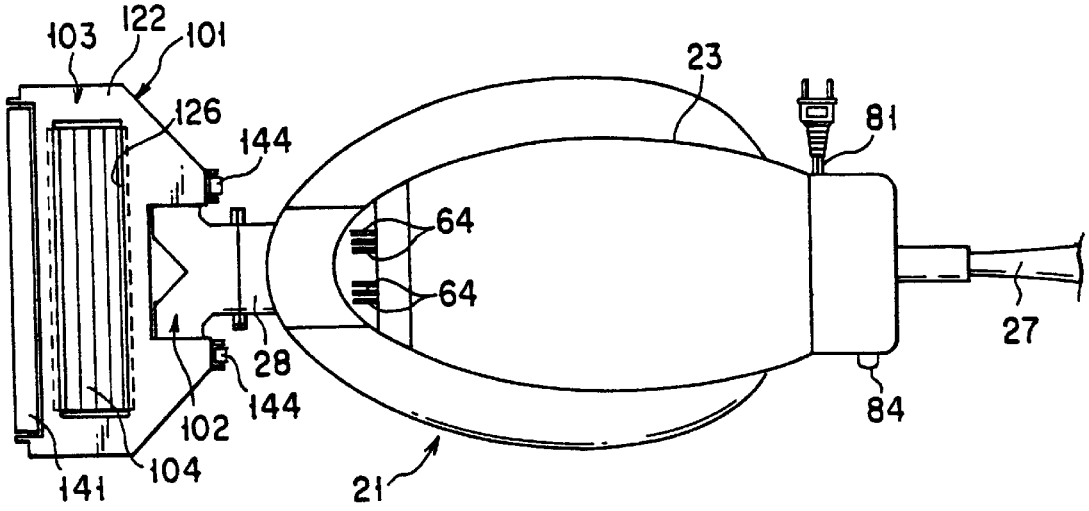
FIG. 2 is a rear view showing the general configuration of the vacuum cleaner shown in FIG. 1.
Figure 3:
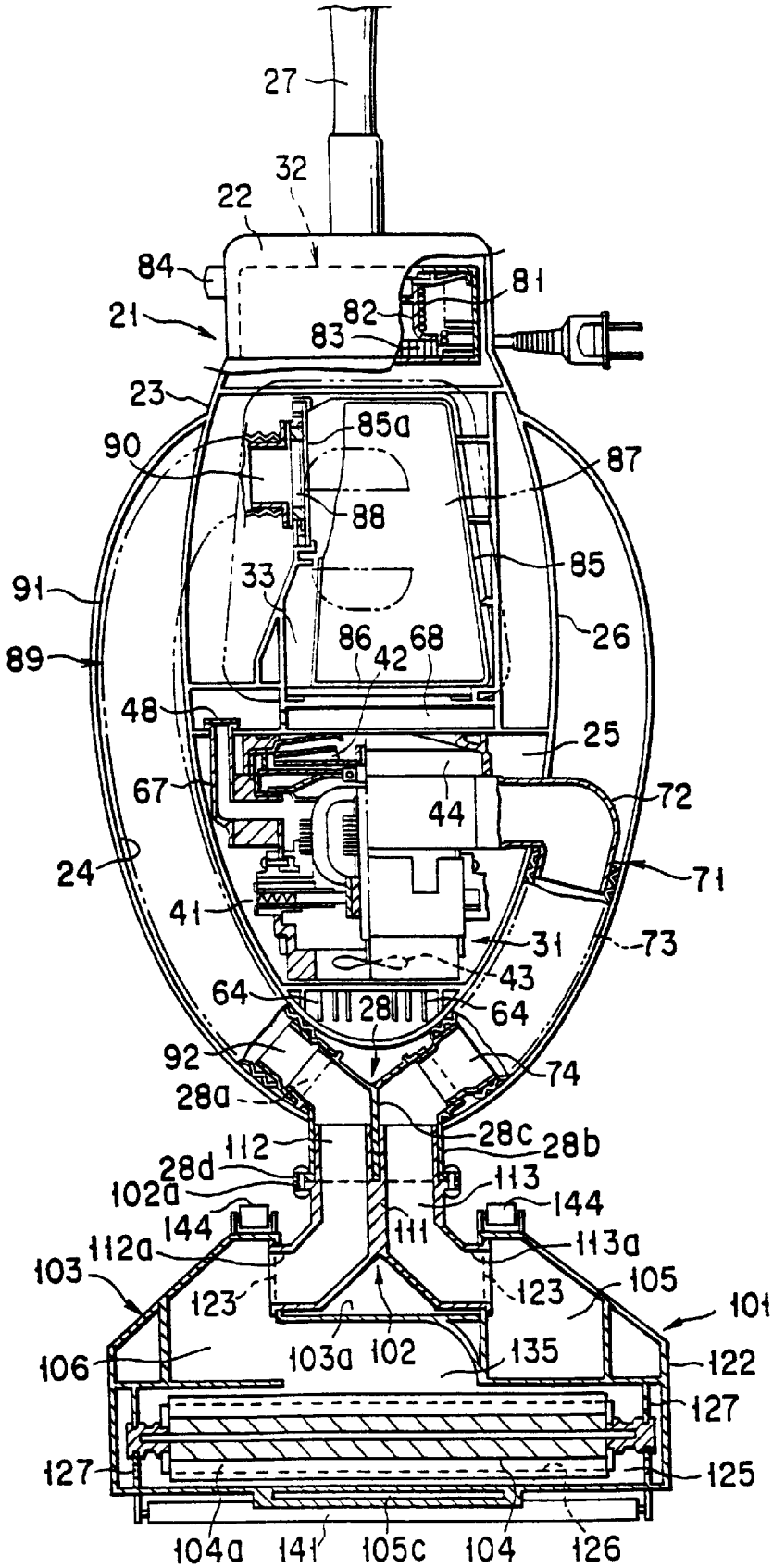
FIG. 3 is a cutaway plan view of the vacuum cleaner shown in FIG. 1, with its upper casing removed.
Figure 4:
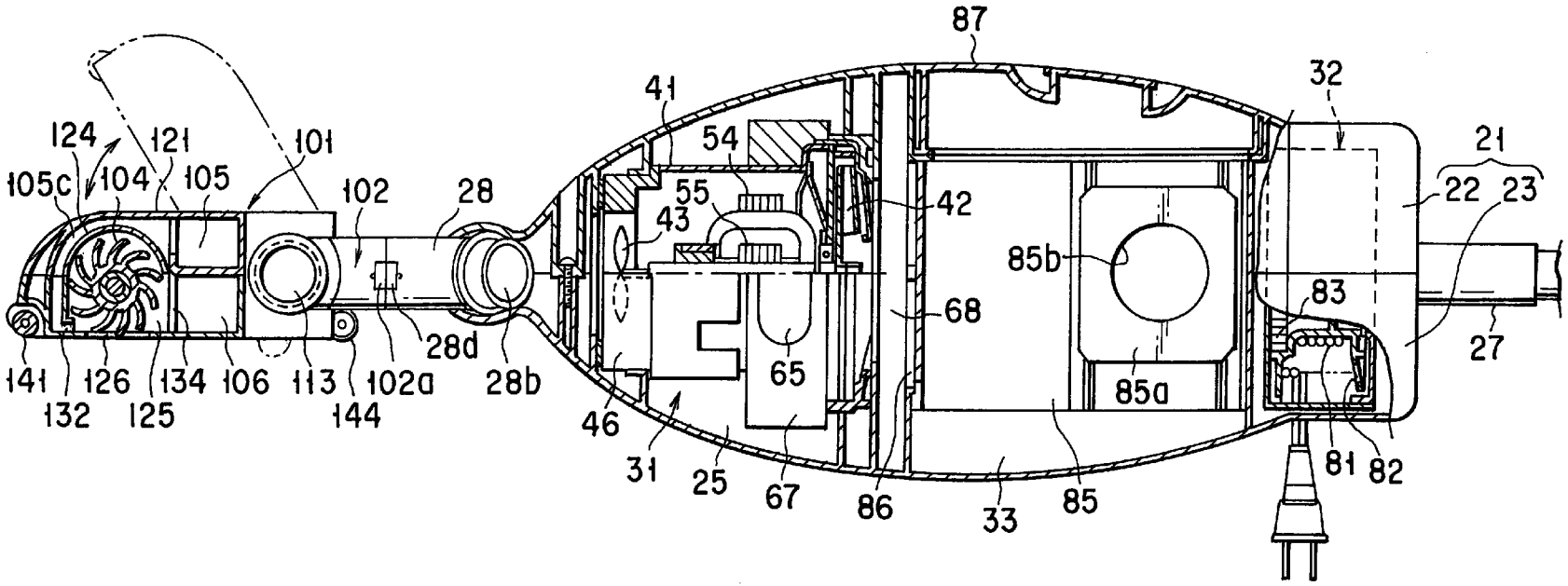
FIG. 4 is a side profile showing the general configuration of the vacuum cleaner shown in FIG. 1.

The cleaner body, which is denoted by numeral 21 in FIGS. 1, 2 and 4, is formed by connecting upper and lower plastic casings 22 and 23 by means of screws or the like. In the cleaner body 21, as shown in FIG. 3, an outer storage section 24, substantially U-shaped in this drawing, and an inner storage section 25 inside the same are divided by a U-shaped partition wall 26. One end portion of the partition wall 26 projects upward in FIG. 3, and a handle 27 for operation protrudes from a wall at the extreme end of the wall 26. As shown in FIG. 1, the upper casing 22 is provided with a pair of notches 22*a* and 22*b*. Part of the outer storage section 24 is exposed through the longer notch 22*a*, and part of the outer storage section 24 is exposed through the shorter notch 22*a*. Those exposed parts are arranged individually on the opposite sides of the central axis of the cleaner body 21.

An interconnector pipe 28 for use as a communicating section is located at the front end portion of the cleaner body 21, on the side opposite from the rear end portion from which the handle 27 protrudes. The interconnector pipe 28, which is a plastic molded piece independent of the cleaner body 21, is substantially Y-shaped, including a first interconnector pipe section 28*a* and a second interconnector pipe section 28*b* that are divided by a diaphragm 28*c*, as shown in FIG. 3. The interconnector pipe 28 is mounted so that the respective parallel one-end portions of its first and second interconnector pipe sections 28*a* and 28*b* project from the cleaner body 21 and that the other end portions of the first and second interconnector pipe sections 28*a* and 28*b*, which are bend in opposite directions, are inserted in the outer storage section 24.

As shown in FIGS. 3 and 4, a motor blower 31 and a cord reel 32 are stored separately in the inner storage section 25, which is provided with a dust chamber 33. The motor blower 31 is located close to the interconnector pipe 28, the cord reel 32 is located close to the handle 27, and the dust chamber 33 is interposed between the motor blower 31 and the cord reel 32. Thus, the interconnector pipe 28, motor blower 31, dust chamber 33, and cord reel 32 are arranged in the order named in the longitudinal direction of the cleaner body 21.

Figure 5:
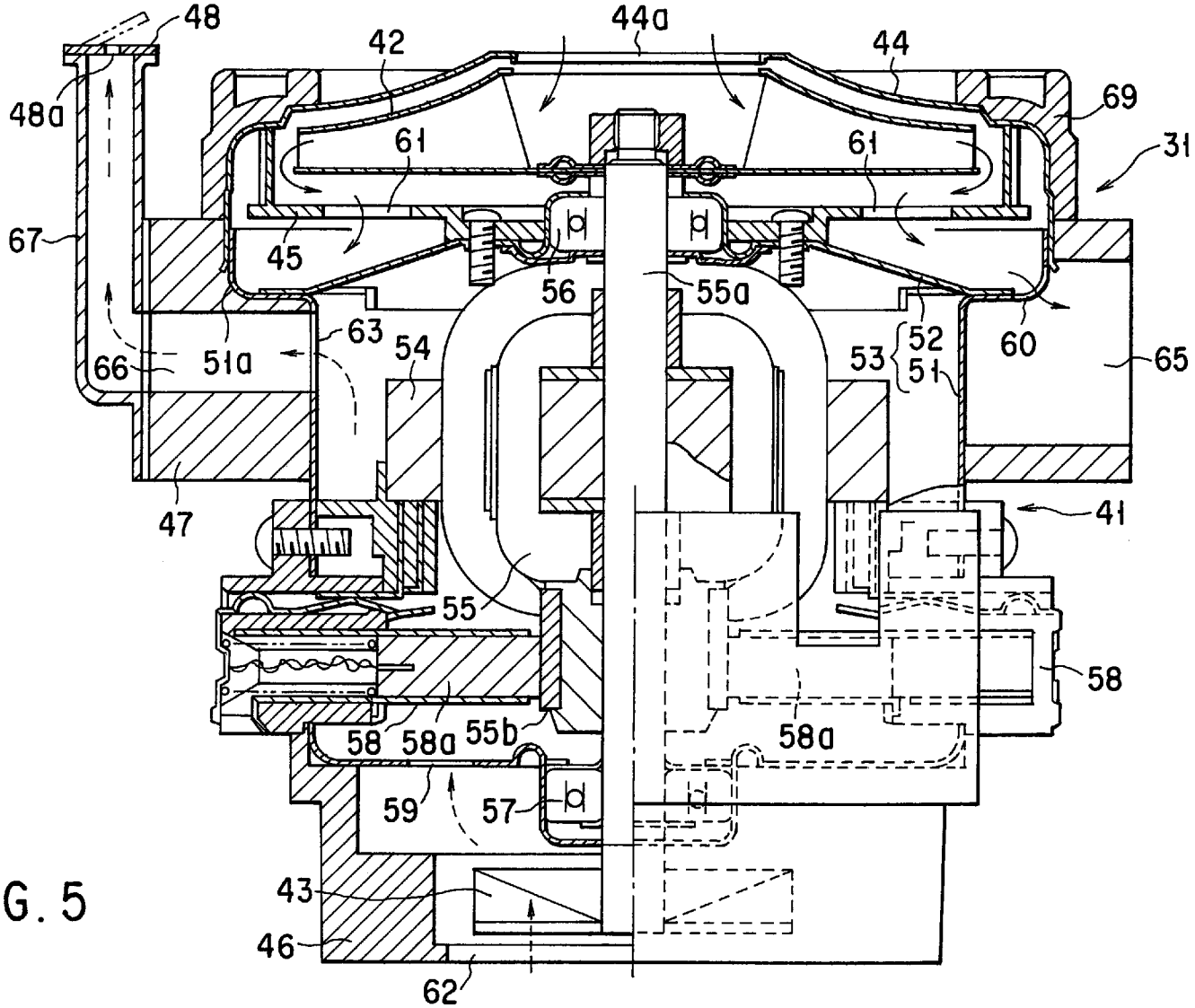
FIG. 5 is a sectional view showing a configuration of a motor blower of the vacuum cleaner shown in FIG. 1.

As shown in FIG. 5, the motor blower 31 is formed in a manner such that an electric motor section 41 is fitted with an air fan 42, cooling fan 43, fan cover 44, inner fan cover 45, fan cover 46, exhaust nozzle 47, cooling valve 48, etc.

More specifically, the electric motor section 41 is formed in a manner such that a stator 54 is stored in a metallic motor frame 53, which is composed of a bottomed cylindrical frame body 51 having one end open and a disk-shaped frame end plate 52 closing the frame body 51, an armature 55 is stored inside the stator 54, its rotating shaft 55*a* is rotatably supported on the motor frame 53 by means of bearings 56 and 57, and a pair of brush units 58 are penetratingly attached to the frame body 51. The distal end of a brush 58*a* of each brush unit 58 is pressed elastically against the outer peripheral surface of a commutator 55*b* of the armature 55. A plurality of suction holes 59 for cooling (only one of which is shown) are bored through the bottom wall of the frame body 51. An open edge portion 51*a* of the frame body 51 has a diameter larger than that of the frame end plate 52, and at least one exhaust aperture 60 is bored through the open edge portion 51*a*.

The opposite end portions of the rotating shaft 55*a* extend through the bearings 56 and 57, individually, and the air fan 42 is mounted on the one end portion that penetrates the bearing 56 so as to be rotatable integrally with the armature 55. The cooling fan 43 is mounted on the other end portion of the rotating shaft 55*a* that penetrates the bearing 56 so as to be rotatable integrally with the armature 55. The metallic fan cover 44 is fittingly attached to the open edge portion 51*a* so as not to close the exhaust aperture 60. The fan cover 44 has a blast inlet 44*a* in its central portion that is located close and opposite to the inlet of the cooling fan 43. The plastic inner fan cover 45 is screwed to the outer surface of the frame end plate 52, and covers the air fan 42 from the side of the frame end plate 52. The distal end of the peripheral wall of the inner fan cover 45 that faces the outlet of the air fan 42 engages the inner surface of the fan cover 44, and a plurality of apertures 61 are bored through the bottom plate portion of the inner fan cover 45. As the air fan 42 rotates, therefore, air that is sucked in through the blast inlet 44*a* passes through the fan cover 44, and is turned along the inner surface of the inner fan cover 45 to be discharged through the apertures 61. Thereafter, the air passes through a space between the inner fan cover 45 and the frame end plate 52, and is discharged from the motor frame 53 through the exhaust aperture 60.

The plastic fan cover 46 is fittingly attached to the bottom-side outer surface of the frame body 51 so as to cover the cooling fan 43 lest the cooling suction holes 59 be closed thereby. The fan cover 46 has a cooling air inlet 62 in its central portion that faces the cooling fan 43. A cooling air outlet 63 is bored through that portion of the frame body 51 on the side of the air fan 42. Thus, air that is sucked in through the cooling air inlet 62 as the cooling fan 43 rotates flows into the motor frame 53 through the cooling fan 43, and flows through the motor frame 53, thereby air-cooling the stator 54 and the like. Thereafter the air is discharged from the motor frame 53 through the cooling air outlet 63. As shown in FIGS. 2 and 3, moreover, a cooling air intake port 64, which communicates with the cooling air inlet 62, is bored through, for example, the lower casing 23 of the cleaner body 21. The cooling air intake port 64 is formed of a plurality of slits. A communication passage that extends from the cooling air intake port 64 to the cooling air inlet 62 is divided from other parts in the cleaner body 21 by partition walls or the like in the cleaner body 21.

The exhaust nozzle 47 is located surrounding that portion of the motor frame 53 on the side of the air fan 42. The exhaust nozzle 47 is provided with an exhaust port 65, which communicates with the exhaust aperture 60, and a cooling exhaust port 66, which is divided from the exhaust port 65 and communicates with the cooling air outlet 63. A conduit 67 is connected to the cooling exhaust port 66, and the cooling valve 48 is attached to the distal end of the conduit 67. As shown in FIG. 3, the distal end portion of the conduit 67 internally connects the motor blower 31 and the dust chamber 33 and communicates with a suction gap 68 between them. As shown in FIG. 5, the cooling valve 48 is a leaf valve that is formed by boring an orifice 48*a* in the central portion of a rubber plate. It closes a distal end opening of the conduit 67 when negative pressure in the suction gap 68 is low. When the negative pressure in the suction gap 68 increases, the cooling valve 48 is elastically deformed to allow the distal end opening of the conduit 67 to open, thereby increasing the cooling air flow. In FIG. 5 and some other drawings, moreover, numeral 69 denotes a rubber vibration-damping packing that is fitted on the outer periphery of the fan cover 44.

The exhaust port 65 of the electric motor section 41 and the second interconnector pipe section 28*b* of the interconnector pipe 28 are connected to each other by means of an internal exhaust air passage 71. The internal exhaust air passage 71 includes an elbow-type exhaust pipe 72 connected to the exhaust port 65, a flexible extensible exhaust hose 73 having one end portion connected to the exhaust pipe 72, and a coupling pipe 74 that is connected to the other end portion of the hose 73 and removably fitted in the second interconnector pipe section 28*b*. The internal exhaust air passage 71 is housed in the outer storage section 24 in a manner such that the greater part of the exhaust hose 73 is exposed through the notch 22*b*. If necessary, therefore, the coupling pipe 74 can be pulled in the direction to shorten the length of the exhaust hose 73 by utilizing the extensibility thereof. By doing this, the exhaust hose 73 can be disengaged from the second interconnector pipe section 28*b* and pulled out through the notch 22*b*. Thus, air that is discharged from the coupling pipe 74 through a blower attachment (not shown), which is connected directly or as required, can be utilized as a blower.

The cord reel 32, which is used to supply power to the motor blower 31, includes a feeder cord 81, a rotatable reel body 82 wound with the feeder cord 81, and a spiral spring 83 for urging the reel body 82 in a winding direction, as shown in FIGS. 3 and 4. The spiral spring 83 is wound up to store spring force as the feeder cord 81 is pulled out. As an unlocking button 84 is depressed, the stored spring force is discharged so that the pulled-out feeder cord 81 is taken up.

The dust chamber 33 is removably stored with a first filter 85 formed of a paper pack, and a second filter 86 in the form of a flat plate is mounted opposite the suction gap 68. The mesh of the second filter 86, which is not indispensable, is coarser than that of the first filter 85. The first filter 85 can be attached to or detached from the dust chamber 33 after a swingable lid 87 mounted on the upper casing 22 is removed. As shown in FIG. 4, an opening frame 85*a* of the filter 85 is provided with an opening 85*b*, which can be opened or closed by means of a seal valve (not shown) that is formed of a thin rubber sheet. Further, a side wall of the dust chamber 33 on which the opening frame 85*a* is set is connected with a dust collection port 88 (see FIG. 3), which opens into the filter 85 through the opening 85*b*.

As shown in FIG. 3, the dust collection port 88 and the first interconnector pipe section 28*a* of the interconnector pipe 28 are connected to each other by means of an internal suction air passage 89. The internal suction air passage 89 includes a suction pipe 90, a flexible extensible suction hose 91 having one end portion connected to the suction pipe 90, and a coupling pipe 92 that is connected to the other end portion of the suction hose 91 and removably fitted on the first interconnector pipe section 28*a*. The internal suction air passage 89 is housed in the outer storage section 24 with that portion of the suction hose 91 on the side of the coupling pipe 92 exposed through the notch 22*a*. If necessary, therefore, the coupling pipe 92 can be pulled in the direction to shorten the length of the suction hose 91 by utilizing the extensibility thereof. By doing this, the suction hose 91 can be disengaged from the first interconnector pipe section 28*a* and pulled out through the notch 22*a*. Thus, air can be sucked in from the coupling pipe 92 through a suction attachment (not shown), which is connected directly or as required.

A plastic suction nozzle 101 internally connects with the interconnector pipe 28. As shown in FIGS. 3, 6 to 9, etc., the suction nozzle 101 includes a connecting pipe 102, main suction-nozzle section 103, cleaning rotor 104, main-section exhaust air passage 105, main-section suction air passage 106, etc. The following is a description of the arrangement of those components.

As shown in FIG. 3, the connecting pipe 102 is substantially Y-shaped, including a first connecting pipe section 112 and a second connecting pipe section 113 that are divided by a diaphragm 111. The connecting pipe 102 is mounted on the interconnector pipe 28 so that the respective parallel one-end portions of its first and second connecting pipe sections 112 and 113 are fitted in the interconnector pipe 28 and that a connecting flange 28*d* and a connecting flange 102*a* are screwed to each other. As this connection is made, the diaphragm 111 is also fitted in the diaphragm 28*c*. By this connection, the first interconnector pipe section 28*a* and the first connecting pipe section 112 are made to communicate with each other, while the second interconnector pipe section 28*b* and the second connecting pipe section 113 are made to communicate with each other. Cylindrical projections 112*a* and 113*a* of the two connecting pipe sections 112 and 113, which project in opposite directions at a distance of 180° from each other, are situated on the same axis. Retaining flanges 112*af* and 113*af* (see FIG. 6), which are continuous in their respective circumferential directions, are provided on the outer peripheries of the distal end portions of these projections 112*a* and 113*a,* respectively.

As shown in FIGS. 6 to 9, the main suction-nozzle section 103 is formed by connecting a main-section upper body 121 and a main-section lower body 122 by screwing or the like. A recess 103*a* is formed in the rear central portion of the main section 103, opening in the upper and lower surfaces and the rear surface thereof. Parallel side walls of the recess 103*a* are provided with circular connecting holes 123, individually. These connecting holes 123 are formed by joining semicircular cuts in the two casings 121 and 122, and have their respective step portions 123*a* (see FIGS. 7 and 8) by which the retaining flanges 112*af* and 113*af* are caught individually from inside the main suction-nozzle section 103. The two connecting holes 123 are fitted individually with the projections 112*a* and 113*a* of the connecting pipe 102. Thus, the connecting pipe 102 is rockably connected to the main suction-nozzle section 103 so as to rise and fall around the connecting holes 123 as bearings. Further, the two connecting pipe sections 112 and 113 of the connecting pipe 102 are allowed independently to communicate with the interior of the main suction-nozzle section 103.

Figure 9:
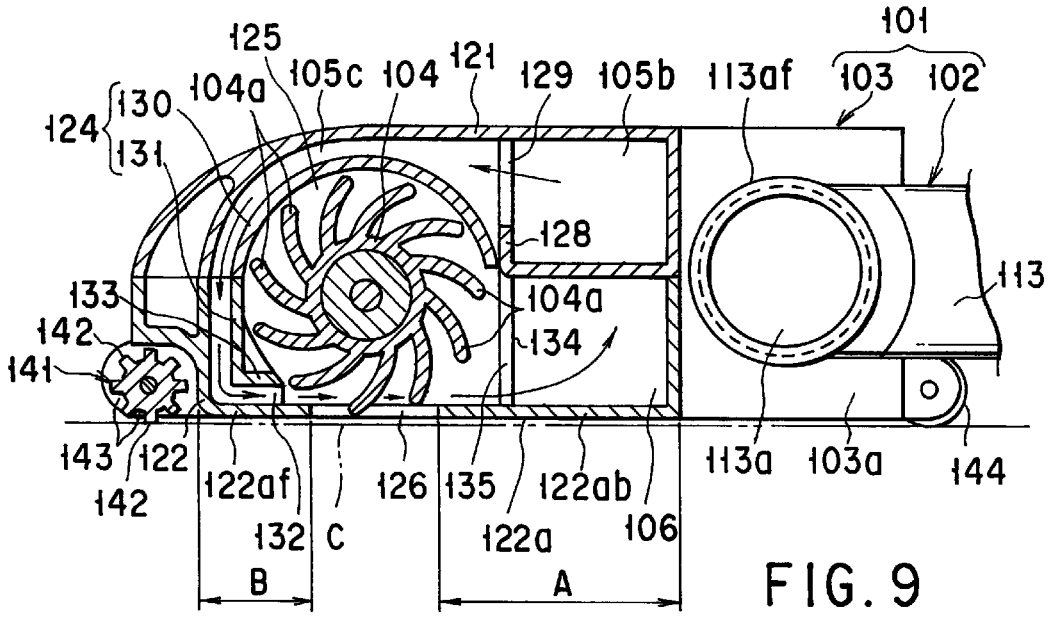
FIG. 9 is a sectional view showing a configuration of the suction nozzle shown in FIG. 6.
Figure 10:
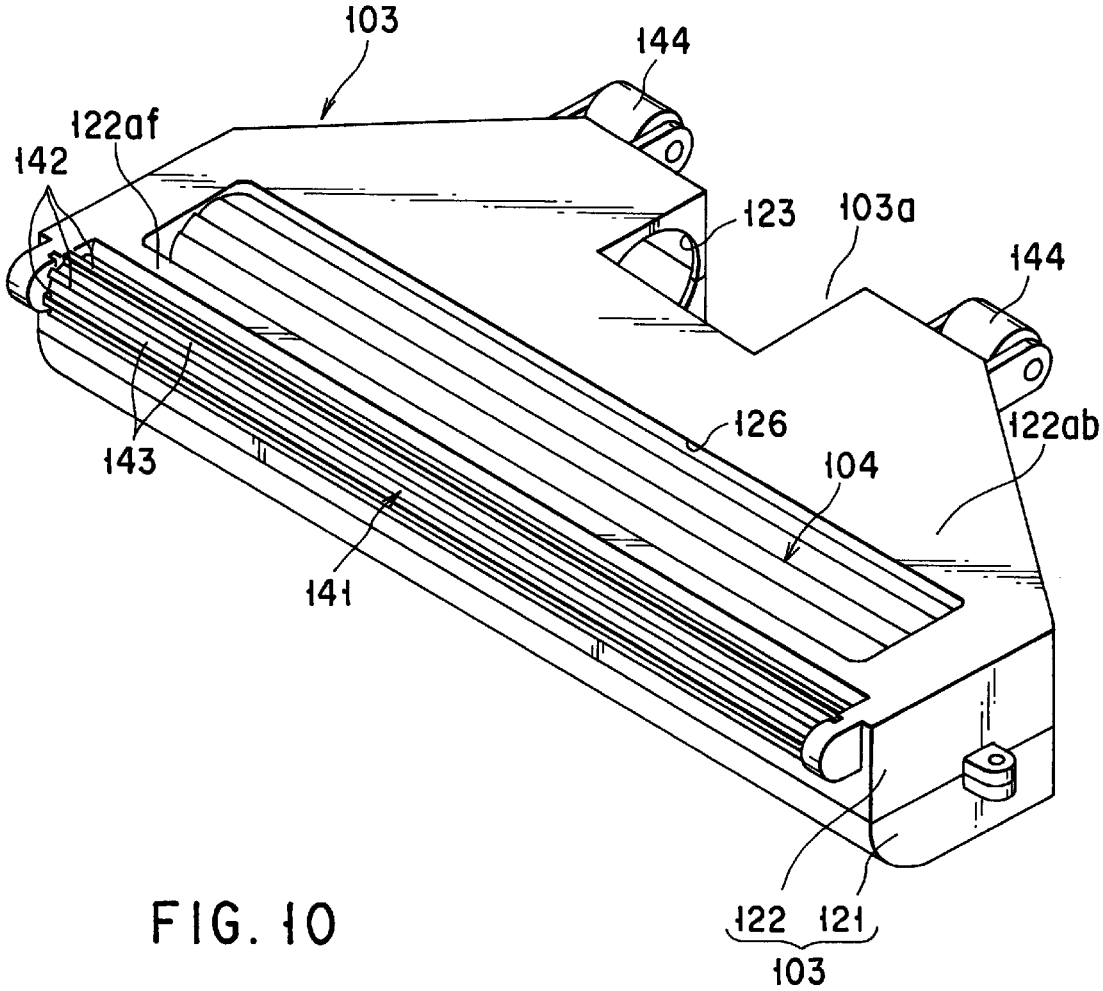
FIG. 10 is a perspective view taken from the bottom side, showing a configuration of a main suction nozzle section of the suction nozzle shown in FIG. 6.

A cleaning rotor chamber 125 is defined inside the front part of the main suction-nozzle section 103 by rib-shaped walls, which project into the upper and lower bodies 121 and 122, and a blast guide 124. Facing this cleaning rotor chamber 125, a rectangular suction port 126 is formed in a bottom wall 122*a* of the main suction-nozzle section 103. The cleaning rotor chamber 125 and the suction port 126 extend in the width direction of the main suction-nozzle section 103. As shown in FIGS. 9, 10, etc., the bottom wall 122*a* includes a front-side bottom wall portion 122*af,* which is situated on the front side of the main suction-nozzle section 103 with respect to the suction port 126, and a rear-side bottom wall portion 122*ab,* which is situated on the rear side (on the side of the connecting pipe 102) of the main suction-nozzle section 103 with respect to the suction port 126. These wall portions are formed of horizontal walls of the same height, individually. The width A of the rear-side bottom wall portion 122*ab* is greater than the width B of the front-side bottom wall portion 122*af.*

The cleaning rotor chamber 125 contains the cleaning rotor 104 therein. The cleaning rotor 104 is mounted so that shaft portions (see FIG. 3), which protrude individually from its longitudinally opposite ends, are rotatably supported between upper and lower rib-shaped bearing walls 127 that divide the longitudinally opposite ends of the cleaning rotor chamber 125. A large number of rubber cleaning blades 104*a* on the peripheral surface of the cleaning rotor 104 extend parallel to one another. In the case where the cleaning blades 104*a* are arranged not parallel to the longitudinal direction of the cleaning rotor 104 but in a manner such that they are twisted in the circumferential direction, it is necessary only that the cleaning blades that are twisted in opposite directions be regulated to form a V-shaped configuration in the longitudinal center of the cleaning rotor 104. Thus, a force that is applied to the cleaning rotor 104 as discharged air is blown against it in the manner mentioned later can be distributed equally on the longitudinally opposite sides of the cleaning rotor 104. The lower end portion of each cleaning blade 104*a* is designed to project through the suction port 126 and be elastically deformed as it taps a to-be-cleaned surface C (see FIG. 9) when it is situated in the central portion of the suction port 126 in the width direction.

The cleaning blades are not limited to the aforesaid ones that are formed of rubber plates, and any other forms may be used for the purpose.

For example, the cleaning blades may be formed of a plurality of bristles that protrude like a plurality of plates on the outer periphery of a cleaning rotor. The cleaning blades are not limited to those bristles either, and may be comb-shaped structures that are formed of a flexible material such as synthetic rubber. Alternatively, the cleaning blades may be formed of a porous material such as sponge or a flexible material such as a fiber or woven cloth.

Blast guide walls are arranged individually in some necessary positions in the main suction-nozzle section 103. Thus, the main suction-nozzle section 103 is formed having therein the main-section suction air passage 106, which internally connects the cleaning rotor chamber 125 and the first connecting pipe section 112, and the main-section exhaust air passage 105, which is divided from the main-section suction air passage 106 and internally connects the cleaning rotor chamber 125 and the second connecting pipe section 113.

Figure 6:
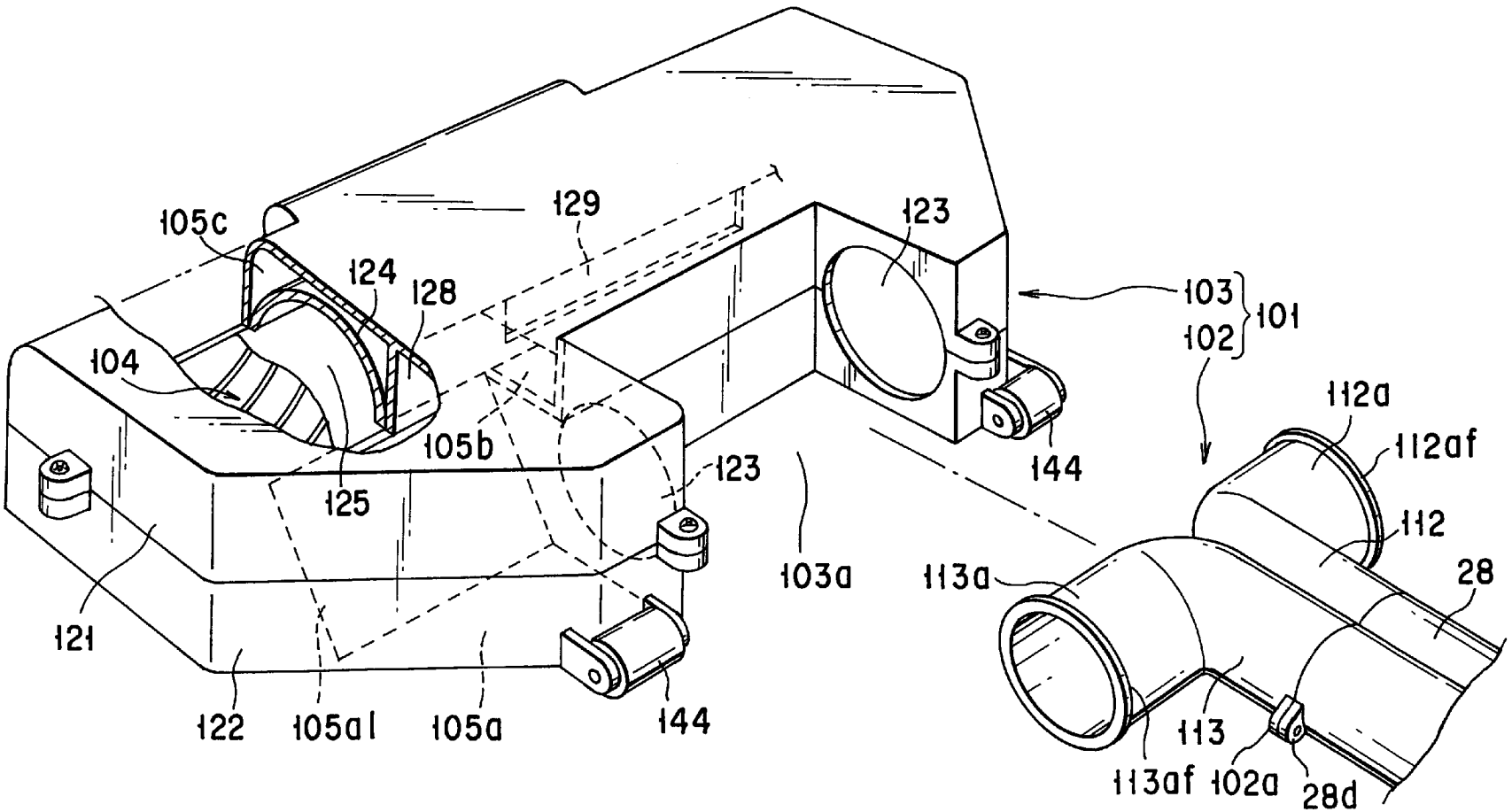
FIG. 6 is a cutaway perspective view showing a configuration of the suction nozzle according to the first embodiment.

The main-section exhaust air passage 105 includes an exhaust air passage chamber 105*a,* which is defined between the upper and lower bodies 121 and 122 and fitted with the projection of the second connecting pipe section 113, a transit exhaust air passage portion 105*b,* which extends in the main-section upper body 121 in the longitudinal direction thereof and has the shape of a rectangular tube, as shown in FIG. 6 and other drawings, and an exhaust air passage portion 105*c* formed in the front part of the main suction-nozzle section 103.

Figure 7:
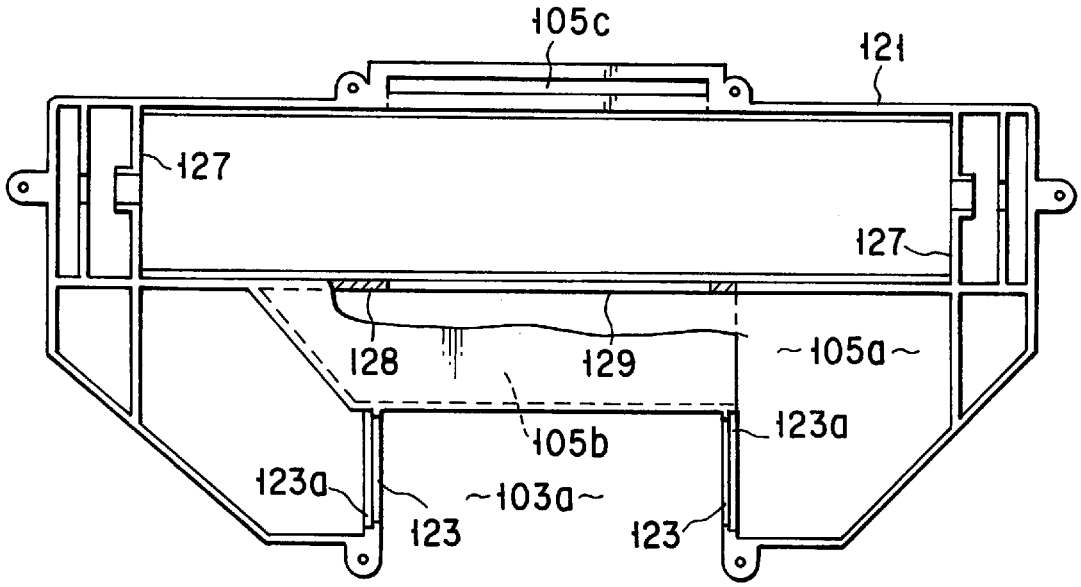
FIG. 7 is a bottom view showing a configuration of a main-section upper body of the suction nozzle shown in FIG. 6.

As shown in FIG. 7, one end of the transit exhaust air passage portion 105*b* in the longitudinal direction thereof opens into the exhaust air passage chamber 105*a,* and the other end in the longitudinal direction is closed. A blast guide wall 128 of the main-section upper body 121, which doubles as a partition wall for dividing the transit exhaust air passage portion 105*b* and the exhaust air passage portion 105*c,* is provided with a communication hole 129 (see FIG. 6) through which the two air passage portions 105*b* and 105*c* communicate with each other. The communication hole 129 is formed extending long and narrow in the width direction of the main suction-nozzle section 103. The underside of the exhaust air passage chamber 105*a* is provided with an upward slope 105*al* for smoothly directing air (exhaust gas) discharged from the second connecting pipe section 113 toward the opening of the transit exhaust air passage portion 105*b*.

As shown in FIG. 9, the plastic blast guide 124 is composed of a first guide plate 130 in the main-section upper body 121 and a second guide plate 131 that is formed continuously with the guide plate 130 and integrally with the main-section lower body 122. The first guide plate 130 is curved along the outer periphery of the upper part of the cleaning rotor 104, thereby forming a curved upper passage in conjunction with the inner surface of the main-section upper body 121. The rear edge portion of the first guide plate 130 in the width direction thereof is bonded to the blast guide wall 128, and divides two air passages 105 and 106 lest the main-section exhaust and suction air passages 105 and 106 communicate with each other on the side of the blast guide wall 128. The second guide plate 131 is provided integrally with the back surface of the central portion of the front wall of the main-section lower body 122 in the longitudinal direction thereof. A top opening (inlet) of a lower passage that is formed inside the second guide plate 131 is continuous with the curved upper passage, and an outlet that opens in the lower end of the lower passage communicates with the central portion of the cleaning rotor chamber 125 in the longitudinal direction thereof.

The aforesaid outlet, which forms a nozzle hole 132 on one side or the front side of the suction port 126 in the width direction thereof, is in the form of a slot elongated in the width direction of the main suction-nozzle section 103 between the suction port 126 and the front-side bottom wall portion 122*af*. Air from the outlet is blown off rearward along the to-be-cleaned surface C, and is blown against the respective lower end portions of the cleaning blades 104*a* of the cleaning rotor 104. The nozzle hole 132 is formed projecting toward the suction port 126, for example. To realize this projecting structure, a blast-guide projecting wall 133 is formed on the lower edge of the second guide plate 131, projecting toward the suction port 126. The blast-guide projecting wall 133 extends parallel to the front-side bottom wall portion 122*af*.

As shown in FIG. 3 and other drawings, the main-section suction air passage 106 has a suction opening 135, which is formed by cutting the central portion of a blast guide wall 134 of the main-section lower body 122, which extends continuously with the blast guide wall 128 and doubles as a partition wall for dividing the cleaning rotor chamber 125, in the longitudinal direction thereof (width direction of the main suction-nozzle section 103). The main-section suction air passage 106 communicates with the first connecting pipe section 112 that is inserted in its rear part. The suction opening 135 is located on the side of the rear-side bottom wall portion 122*ab*, and at least its lower part is situated substantially flush with the nozzle hole 132.

Figure 8:
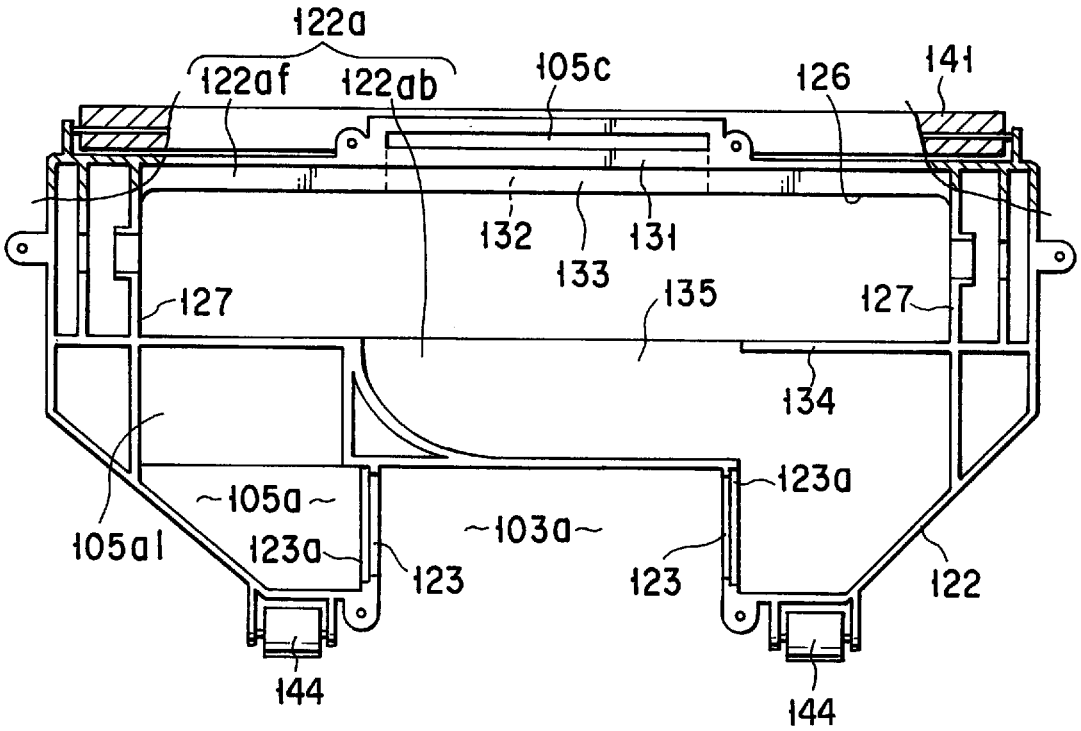
FIG. 8 is a plan view showing a configuration of a main-section lower body of the suction nozzle shown in FIG. 6.

Situated in front of the suction port 126, as shown in FIGS. 8, 10, etc., a seal roller 141 is rotatably mounted on the main suction-nozzle section 103 with its opposite end portions pivotally supported. The seal roller 141, which extends in the width direction of the main suction-nozzle section 103, that is, at right angles to the moving direction of the suction nozzle 101, is longer than the suction port 126 and has a length substantially covering the full width of the main suction-nozzle section 103. Part of the outer periphery of the seal roller 141 slightly projects from at least the undersurface of the main-section lower body 122, out of the undersurface and front surface thereof.

The seal roller 141 has a plurality of ridges 142 continuously extending on its outer periphery in the axial direction thereof and grooves 143 formed between the ridges 142. According to the first embodiment, the ridges 142 and the grooves 143 extend parallel to the axial direction. The ridges 142 protrude from the undersurface of the main-section lower body 122. The height of projection of the ridges 142 is 1.5 mm or thereabout.

The outer peripheral portion of the seal roller 141, which has the ridges 142 and the grooves 143, may be formed of a rigid material, e.g., a rigid synthetic resin. Preferably, however, it should formed of a flexible material such as rubber. The use of rubber is advantageous in that it can facilitate the ridges 142 to be caught by the to-be-cleaned surface C and the seal roller 141 to rotate. According to the arrangement in which the seal roller 141 is designed to project slightly from the front face of the suction nozzle 101 as illustrated, moreover, the roller 141 can be utilized as a cushioning bumper, whereby the possibility of wall surfaces, furniture, etc. in a room being marred can be lowered.

Further, a pair of rear wheels 144 are mounted on the rear part of the main suction-nozzle section 103. The respective lower end portions of these wheels 144, like that of the seal roller 141, project slightly (for about 1.5 mm) from the undersurface of the main-section lower body 122. Thus, the bottom wall 122*a* is separated slightly from the to-be-cleaned surface C, so that the suction nozzle 101 can be smoothly moved back and forth as the seal roller 141 and the rear wheels 144 rotate.

The upright vacuum cleaner having the construction described above is used in cleaning in a manner such that the handle 27 is held with the pulled-out feeder cord 81 from its cord reel 32 connected to the power supply, the motor blower 31 is operated as the cleaner body 21 is moved, and the suction nozzle 101 is moved along the to-be-cleaned surface C, such as a floor surface.

In this cleaning operation, the air fan 42 and the cooling fan 43 of the motor blower 31 are rotated simultaneously. Accordingly, air that contains dust is sucked in through the suction port 126 of the suction nozzle 101 by a sucking action that is caused as the air fan 42 rotates. This air is discharged from the cleaning rotor chamber 125, and delivered to the first connecting pipe section 112 on the suction side through the main-section suction air passage 106 and then to the first interconnector pipe section 28*a* of the interconnector pipe 28. Thereafter, the air is sucked into the filter 85 in the dust chamber 33 through the internal suction air passage 89. Since the air sucked in along this course of suction passes through the filter 85, dust in the air is seized by the filter 85 in the meantime.

The air run through the filter 85 and the filter 86 just behind it flows through the suction gap 68 just behind the filter 86, and is sucked into the air fan 42 through the blast inlet 44*a* of the motor blower 31. The air is discharged from the outlet of the air fan 42 after flowing along the air blades thereof. The discharged air passes through the exhaust aperture 60, and is discharged from electric motor section 41 through the exhaust port 65 of the exhaust nozzle 47. The flow of the air through the motor blower 31 is indicated by solid-line arrows in FIG. 5.

The air discharged in this manner, that is, exhaust gas from the motor blower 31, is discharged into the main-section exhaust air passage 105 via the second interconnector pipe section 28*b* of the interconnector pipe 28 and the second connecting pipe section 113 on the exhaust side of the connecting pipe 102 after passing through the internal exhaust air passage 71. Accordingly, the air is forcibly blown against the cleaning blades 104*a* of the cleaning rotor 104 through the nozzle hole 132 of the air passage 105. Thereupon, the exhaust gas is returned to the suction port 126, and the cleaning rotor 104 in the cleaning rotor chamber 125 is rotated under its influence. Thus, the lower end portion of each cleaning nozzle 104*a* is struck against the to-be-cleaned surface C that closely faces the suction port 126, thereby raking out dust on the to-be-cleaned surface C of a carpet or the like. At the same time, the exhaust gas, returned to the suction port 126 in this manner, is recovered and circulated in the aforesaid course of suction that includes the suction opening 135 of the main-section suction air passage 106 as an inlet. As the air is thus circulated, the dust and the like raked out from the to-be-cleaned surface C in the aforesaid manner are also recovered in the course of suction. The flow of air that flows back through the suction nozzle 101 is indicated by solid-line arrows in FIG. 9.

Since the exhaust gas is circulated without being discharged to the outside, the dust and the like cannot be blown off to the outside by the exhaust gas. Moreover, the discharge of operating sounds of the motor blower 31 that propagate in the exhaust gas, and more specifically, blowing sounds produced by the air fan 42, is so small that noises produced during use can be reduced substantially. Thus, this vacuum cleaner is suited for use in a silent environment, such as in a hospital or in the night.

Further, the cleaning rotor 104 is rotated positively to rake out the dust on the to-be-cleaned surface C into the cleaning rotor chamber 125 by utilizing the energy of the exhaust gas that is returned to the suction port 126 in the aforesaid manner, and the dust is sucked in through the suction port 126 by means of the recovered air, so that the dust collection performance can be improved. Furthermore, the suction nozzle 101 is attracted to the to-be-cleaned surface C less frequently, so that the suction nozzle 101 can be moved more easily.

Since the cooling fan 43 is rotated simultaneously during cleaning operation, the outside air is sucked in correspondingly from outside the cleaner body 21 through the cooling air intake port 64. This outside air subjects the stator 54 and the armature 55 in the motor frame 53 to air-cooling as it circulates in the motor frame 53, and is discharged through the cooling exhaust port 66. Thereafter, the air is sucked into the motor blower 31 through the conduit 67 and the suction gap 68. This flow of air is indicated by dotted-line arrows in FIG. 5.

If the quantity of dust in the filter 85 is so small that the air passage resistance in the filter 85 is low when the outside air is sucked in the aforesaid manner, the distal end opening of the conduit 67 is closed by the cooling valve 48, so that a very small quantity of cooling outside air that passes through the orifice 48*a* of the cooling valve 48 is sucked into the motor blower 31. In this state, the cooling fan 43 is cooled mainly by air that is sucked into the motor blower 31 via the dust chamber 33, while the electric motor section 41 is cooled by the cooling outside air that flows in the motor frame 53.

If the negative pressure in the dust chamber 33 is raised as the air passage resistance in the filter 85 increases with the increase of the quantity of dust in the filter 85, the negative pressure in the suction gap 68 is also raised. Therefore, the cooling valve 48 is moved to a position such that the distal end of the conduit 67 is opened, as indicated by two-dot chain line in FIG. 5. Accordingly, the cooling outside air is sucked in large quantities into the motor blower 31. As the outside air is introduced in this manner, the electric motor section 41 and the air fan 42 of the motor blower 31 are mainly cooled. Since the introduction of the cooling outside air is thus controlled in accordance with the degree of accumulation of dust in the filter 85, the temperature of the motor blower 31 can be restrained from increasing without regard to the quantity of dust in the filter 85.

In the aforementioned cleaning operation, the nozzle hole 132 through which the air that flows back into the suction port 126 is blown off toward the suction port 126 opens not downward but rearward, as shown in FIG. 9. Accordingly, the air blown off from the nozzle 132 toward the cleaning blades 104*a* is blown off along the inner surface of the bottom wall 122*a* of the main suction-nozzle section 103 that faces the to-be-cleaned surface C, in a horizontal direction substantially parallel to the to-be-cleaned surface C. In other words, the air is blown off along the to-be-cleaned surface C. Then, the air is sucked into the suction opening 135 via the cleaning blades 104*a*.

As the air thus flows around the suction port 126, it can be prevented from running against the to-be-cleaned surface C in an intersecting manner and generating a turbulent flow, so that the circulating air can be restrained from partially leaking out through the gap between the to-be-cleaned surface C and the bottom wall 122*a*.

Further, some of the air blown off through the nozzle hole 132 is urged to pass through the suction port 126 in its blowing direction and leak out through the gap between the to-be-cleaned surface C and the bottom wall 122*a* of the suction nozzle 101. Since the width A of the rear-side bottom wall portion 122*ab* on the lower-stream side with respect to the blowing direction is much greater than the width B of the front-side bottom wall portion 122*af* on the upper-stream side with respect to the blowing direction, however, the air resistance in the gap between the rear-side bottom wall portion 122*ab* and the to-be-cleaned surface C can be increased in proportion to the greater width A. Thus, the leakage of the air through the aforesaid gap to the outside can be restricted by this substantial air resistance.

As mentioned before, moreover, the nozzle hole 132 projects along the to-be-cleaned surface C toward the suction opening 135, for example, so that the directivity of the air blown off through the nozzle hole 132 can be improved, and a blast that is urged to pass through the suction port 126 can be lessened. Since at least the lower part of the suction opening 135 and the nozzle hole 132 are substantially flush with each other, as mentioned before, moreover, the leakage of the air from between the bottom wall 122*a* and the to-be-cleaned surface C can be further reduced by causing the air blown off through the nozzle hole 132 to flow straight toward the suction opening 135. As mentioned before, furthermore, the blast that passes through the suction port 126 is very little, so that the quantity of air blown against the cleaning blades 104*a* can be kept at a higher level. Accordingly, the force (torque) to rotate the cleaning rotor 104 can be enhanced by means of the air blown off through the nozzle hole 132. Thus, the raking capacity for dust in the to-be-cleaned surface C can be improved.

When the air is circulated for cleaning in the aforesaid manner, the suction nozzle 101 is pushed or pulled as it is moved in the longitudinal direction along the to-be-cleaned surface C. When the suction nozzle 101 is forced to advance during this movement, the seal roller 141 in front of the suction port 126 is rotated forward as the suction nozzle 101 advances with the lower end portion of the roller 141 in contact with the to-be-cleaned surface C. This rotation enables the seal roller 141 easily to get over fine dust (including sand and the like) on the to-be-cleaned surface C without pushing aside the dust. Thus, the seal roller 141 can be prevented from pushing the dust forward, and never hinders the suction of the dust through the suction port 126.

Since the seal roller 141, which rotates in the aforesaid manner, is in contact with the to-be-cleaned surface C, so that the seal roller 141 can be utilized as a windbreak wall that is situated in that portion of the gap between the to-be-cleaned surface C and the bottom wall 122*a* of the suction nozzle 101 on the front side of the suction nozzle 101 in the moving direction thereof. Thus, the presence of the seal roller 141 can prevent some of the circulating air run through the suction port 126 from leaking out forward in the moving direction of the suction nozzle 101 through the gap, and any of the circulating air can never be blown off ahead of the suction nozzle 101 that is forced to move. Accordingly, lightweight dust on the to-be-cleaned surface C situated ahead of the suction nozzle 101 that is forced to move can be prevented from being blown away. Since the seal roller 141 gets over the dust in the aforesaid manner, moreover, the dust situated ahead of the suction nozzle 101 in the moving direction thereof can be securely sucked in the suction nozzle 101 moves.

Since the ridges 142 and the grooves 143 are formed alternately on the outer periphery of the seal roller 141, furthermore, the seal roller 141 scarcely runs on the fine dust on the to-be-cleaned surface C as it gets over the dust. Thus, formation of a narrow gap between the to-be-cleaned surface C and the seal roller 141, corresponding to the fine dust, can be prevented, the function of the seal roller 141 as a windbreak wall can be enhanced, and the dust situated ahead of the suction nozzle 101 can be securely sucked in and cleared without being blown away.

Since the seal roller 141 rotates with the dust in its grooves 143, moreover, it can easily get over the dust as it rotates. Besides, the seal roller 141 rotates with its ridges 142 in contact with the to-be-cleaned surface C, so that it can more easily rotate enjoying a great force to grip the to-be-cleaned surface C. Accordingly, the seal roller 141 can be securely prevented from slipping on the to-be-cleaned surface C so that the suction nozzle 101 is forced to move. Thus, the seal roller 141 can be securely prevented from pushing the dust forward.

Further, the seal roller 141 is not attached to the rear-side bottom wall portion 122*ab* behind the suction port 126 of the suction nozzle 101. Since the rear-side portion is already cleaned by the suction through the suction port 126, however, rearward leakage of some of the circulating air, if any, only causes a small quantity of dust that remains without being fully sucked in to be blown away without involving any substantial problem.

The present invention is not limited to the upright vacuum cleaner according to the first embodiment described above, and is also applicable to vacuum cleaners of the canister type and various other types. Accordingly, the suction nozzle 101 may be a suction nozzle 101 that is connected to the cleaner body 21 by means of a transit pipe, such as an extension pipe that includes an external suction air passage and an external exhaust air passage, or an air hose.

According to the present invention, moreover, the seal roller 141 may be provided behind the suction port 126 as well as in front of it. In the case where the seal roller 141 is provided on either side of the suction port 126 in the width direction thereof, the dust on the to-be-cleaned surface to be blown away by air leakage can be reduced.

In the case where the seal roller 141 has the ridges 142 and the grooves 143 arranged alternately in the circumferential direction on its outer periphery, furthermore, the ridges 142 and the grooves 143 that extend throughout the length of the roller 141 may be twisted spirally.

According to the embodiment described above, the rotatable seal roller is provided to prevent some of the circulating air run through the suction port from leaking forward in the moving direction of the suction nozzle through the gap between the to-be-cleaned surface and the suction nozzle. Accordingly, the dust on the front side in the moving direction of the suction nozzle can be prevented from being blown away, and the fine dust on the to-be-cleaned surface is prevented from being pushed aside. In consequence, the dust on the to-be-cleaned surface can be sucked in through the suction port easily and securely. Thus, the suction performance for the dust on the to-be-cleaned surface can be improved.

Further, the ridges and the grooves on the seal roller facilitate the seal roller to fulfill its function as a windbreak wall and make the rotation of the seal roller easier. Accordingly, the seal roller can be securely prevented from slipping on the to-be-cleaned surface and pushing aside the fine dust on the to-be-cleaned surface, whereby the suction performance for the dust on the to-be-cleaned surface can be improved.

Figure 11:
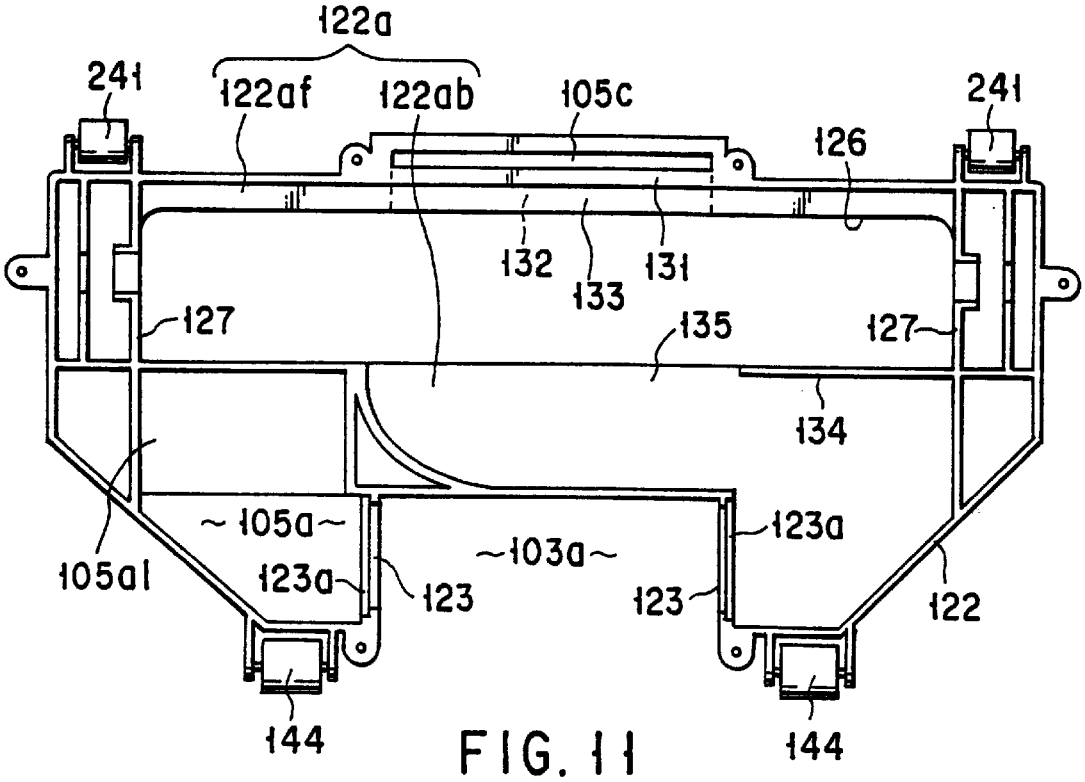
FIG. 11 is a plan view showing a configuration of a main-section lower body of a suction nozzle of a second embodiment.
Figure 12:
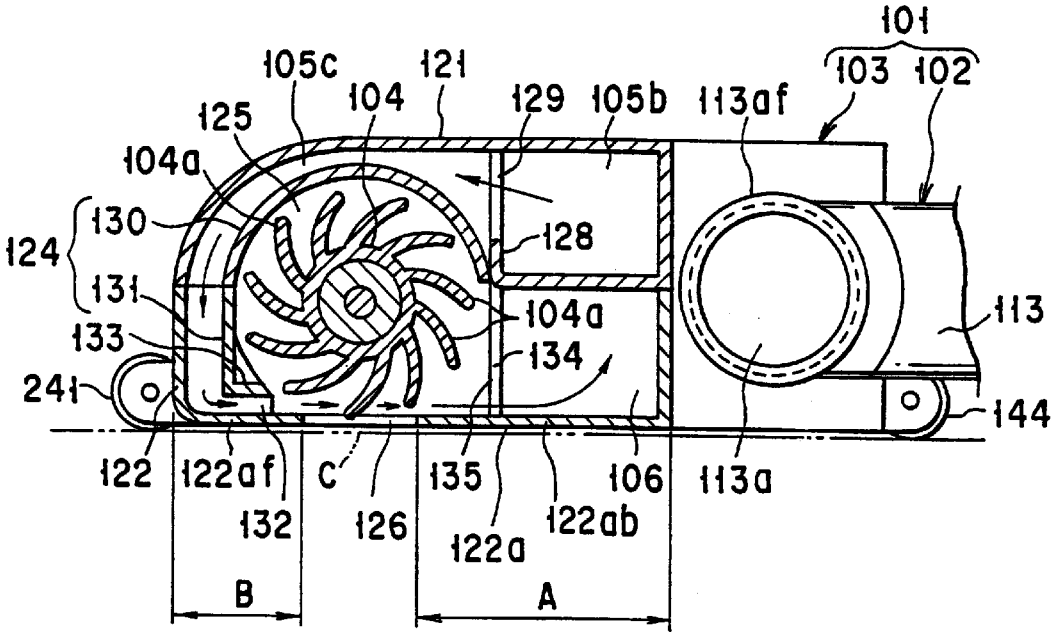
FIG. 12 is a sectional view showing a configuration of the suction nozzle of the second embodiment.

Referring now to FIGS. 11 and 12, there will be described a second embodiment of the present invention. As shown in FIGS. 11 and 12, the seal roller according to the first embodiment is omitted, and a pair of front wheels 241 are rotatably mounted on the front part of the main suction-nozzle section 103 of the suction nozzle 101 instead.

Although the aforementioned seal roller is not provided, according to the present embodiment, air jetted from the nozzle hole 132 runs against the cleaning blades 104*a* and flows rearward along the to-be-cleaned surface C to be sucked into the suction opening 135, along with the cleaning blades. Accordingly, the flow of the air jetted from the nozzle hole 132 cannot be disturbed in the suction port 126, so that the air can be effectively prevented from leaking out.

According to this embodiment, moreover, at least the lower part of the suction opening 135 and the nozzle hole 132 are substantially flush with each other, as mentioned before, moreover, so that the air jetted from the nozzle hole 132 is sucked straight into the suction opening 135. Thus, the flow of the air cannot be disturbed in the suction port 126, so that the air can be effectively prevented from leaking out.

For other particulars than the points described above, the second embodiment has the same construction and functions as the first embodiment. In FIGS. 11 and 12, therefore, like numerals refer to portions that have their respective counterparts in the first embodiment, and a description of those portions is omitted.

Referring now to FIGS. 13 to 16, there will be described a third embodiment of the present invention. This is of a so-called canister type such that the cleaner body and the suction nozzle are connected by means of a flexible hose or the like. In this case, a screen portion is formed around the suction port of the suction nozzle, whereby air is prevented from leaking out.

Figure 13:
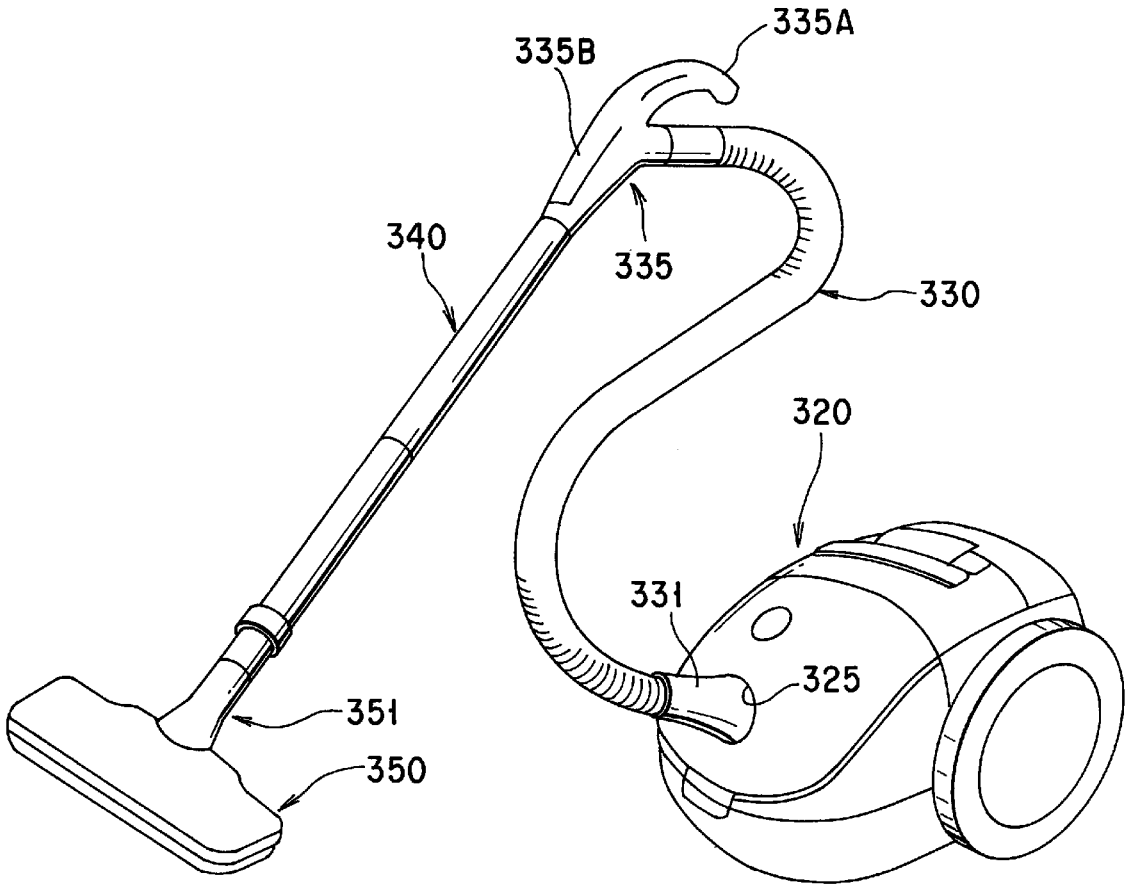
FIG. 13 is a general perspective view of a vacuum cleaner of a third embodiment.
Figure 14:
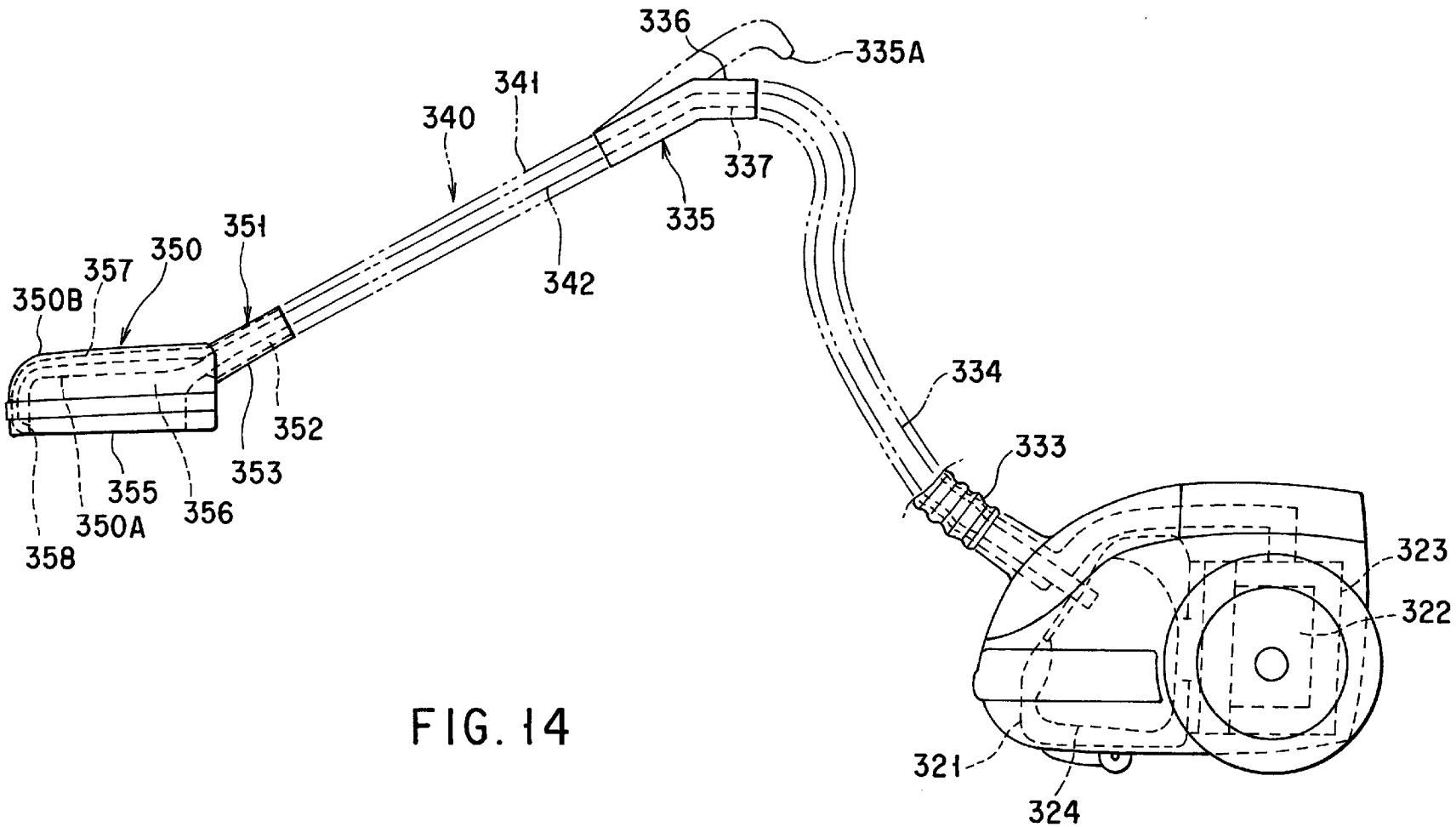
FIG. 14 is a schematic side view showing the general configuration of the vacuum cleaner of the third embodiment.
Figure 15:
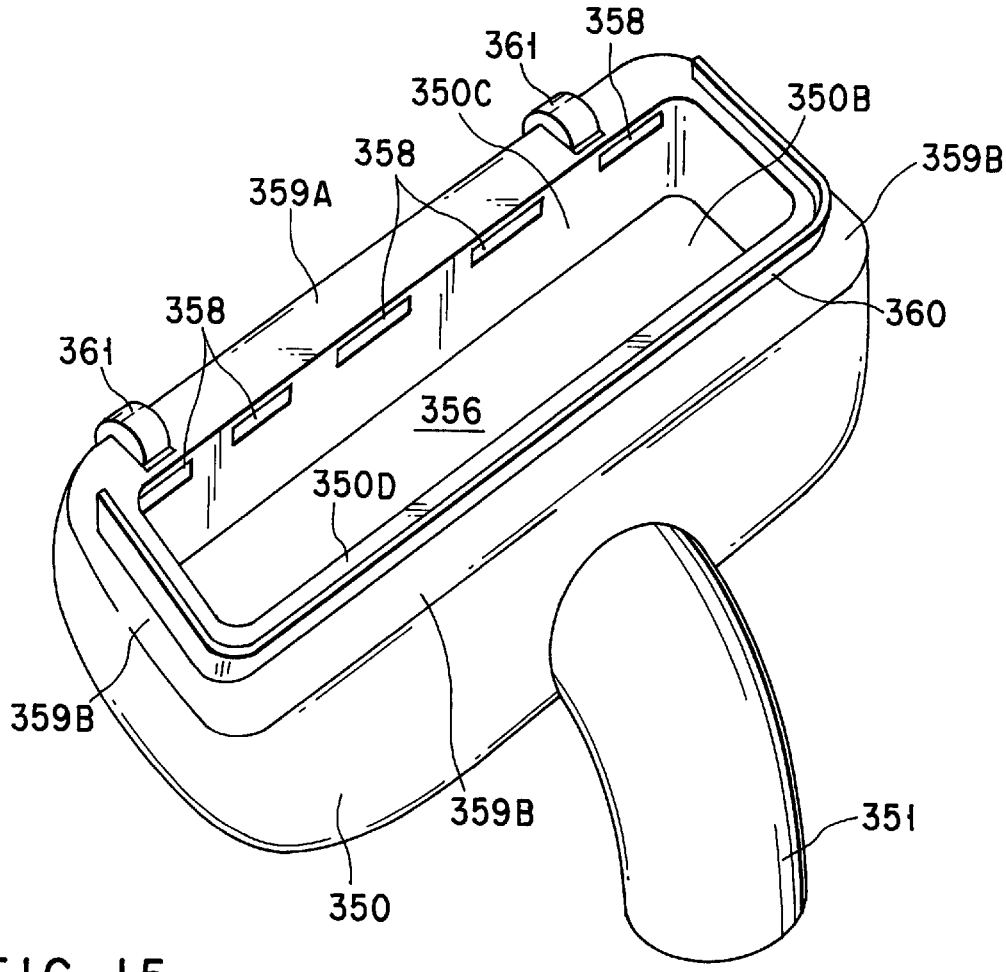
FIG. 15 is a perspective view of a suction nozzle of the third embodiment.
Figure 16:
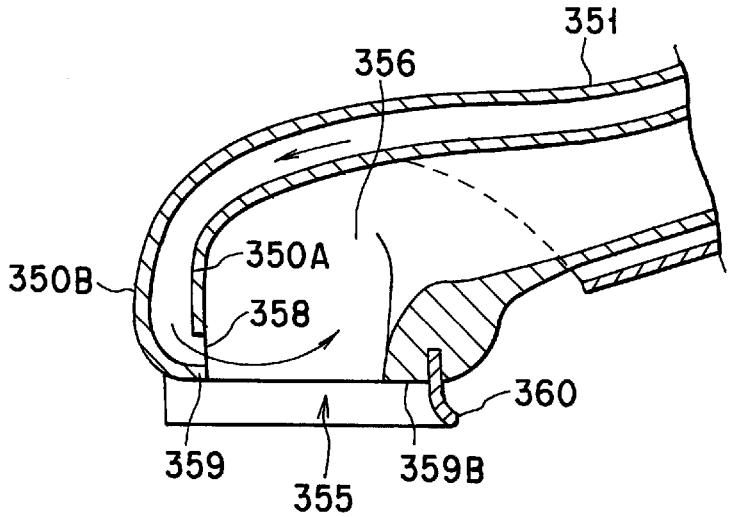
FIG. 16 is a schematic sectional view of the suction nozzle of the third embodiment.

In FIGS. 13 and 14, 320 denotes a vacuum cleaner body. The body 320 is provided inside with a dust chamber 321, a motor blower 322 for adjusting the dust chamber 321 to a negative pressure, and an exhaust chamber 323 into which air is discharged from the motor blower 322. The dust chamber 321 is fitted with a dust filter 324, and a connecting section 331 of a hose 330 is removably connected to a connecting port 325 in the body 320.

The hose 330 has a dual structure including an exhaust hose 333 and a suction hose 334 fitted therein. When the hose 330 is connected to the connecting port 325, the suction hose 334 communicates with the dust chamber 321, and the exhaust hose 333 communicates with the exhaust chamber 323.

A hand operating pipe 335 is provided at the other end of the hose 330. An extension pipe 340 is removably connected to the hand operating pipe 335, and the distal end portion of the extension pipe 340 is removably connected to a connecting pipe 351 of a suction nozzle 350.

The hand operating pipe 335 is provided with a grip section 335A and an operating section 335B. The operating section 335B is provided with an operating switch (not shown) for turning the motor blower 322 on and off and setting the output.

The hand operating pipe 335, like the hose 330, includes an exhaust pipe section 336 and a suction pipe section 337 therein. The exhaust pipe section 336 and the exhaust hose 333 are connected to each other, while the suction pipe section 337 and the suction hose 334 are connected to each other.

As shown in FIG. 14, the extension pipe 340 has a dual structure including an exhaust pipe 341 and a suction pipe 342 fitted therein. The exhaust pipe 341 is connected to the exhaust pipe section 336 of the hand operating pipe 335, and the suction pipe 342 is connected to the suction pipe section 337. The inside diameter of the exhaust pipe 341 is adjusted to 1.6 times as large as the inside diameter of the suction pipe 342. Likewise, the inside diameter of the exhaust pipe section 336 of the hand operating pipe 335 is adjusted to 1.6 times as large as the inside diameter of the suction pipe section 337, and the inside diameter of the exhaust hose 333 of the hose 330 is adjusted to 1.6 times as large as the inside diameter of the suction hose 334.

The connecting pipe 351 of the suction nozzle 350 has a dual structure including an outer pipe 352 and an inner pipe 353 fitted in the outer pipe 352. The outer pipe 352 is connected to the exhaust pipe 341 of the extension pipe 340, and the inner pipe 353 is connected to the suction pipe 342. The inside diameter of the outer pipe 352 is also adjusted to 1.6 times as large as the inside diameter of the inner pipe 353.

The suction nozzle 350 is formed with a suction chamber 356 that has a suction opening 355 (suction port) in its base, the suction chamber 356 communicating with the inner pipe 352 of the connecting pipe 351. Formed between an inner wall 350A and outer wall 350B of the suction nozzle 350, moreover, is a space section 357 that communicates with the outer pipe 352 of the connecting pipe 351. A vertical wall surface 350C of the inner wall 350A is formed having a plurality of nozzle holes 358 (blow-off ports) through which air is blown against the floor surface, the nozzle holes 358 communicating with the space section 357. The nozzle holes 358 are arranged on that side of the suction nozzle 350 opposite from the region for the attachment of the connecting pipe 351.

The suction chamber 356 of the suction nozzle 350 communicates with the dust chamber 321 of the body 320 by means of the inner pipe 352, suction pipe 342, suction pipe section 337, and suction hose 334, while the exhaust chamber 323 of the body 320 communicates with the suction chamber 356 by means of the exhaust hose 333, exhaust pipe section 336, exhaust pipe 341, outer pipe 352 of the suction nozzle 350, space section 357, and nozzle holes 358.

The nozzle holes 358 are directed toward the other or inside vertical wall surface 350D that faces the vertical wall surface 350C, and extend substantially horizontally so that exhaust gas can be blown off along the floor surface as an object of cleaning.

A lip 360 (screen portion) for screening the gap between the suction nozzle 350 and the floor surface is formed over the whole area of an edge portion 359 around the suction opening 355 except the region (front part of the suction port) near the nozzle holes 358. According to this embodiment, the lip 360 is formed of a soft plastic, and the basal part of the lip 360 is embedded in the edge portion of the suction opening 355 of the suction nozzle 350. The lip 360 protrudes from the rear part and left- and right-hand parts of the suction nozzle 350, and the height of its projection is substantially the same as that of a pair of rollers 361, 361 on the front part of the suction nozzle 350.

A brush or seal rubber may be provided as the screen portion in place of the lip 360. The screen portion may be formed in a manner such that the height of projection of an edge portion 359A between the pair of rollers 361, 361 on the floor surface side is less than that of edge portions 359B on which the lip 360 is formed. By doing this, the edge portion of the suction nozzle 350 can be formed so that the gap between the edge portion 359A at the front part of the suction nozzle 350 and the floor surface is wider than the gap between each edge portion 359B and the floor surface when the suction nozzle 350 is held against the floor surface.

The following is a description of the operation of the vacuum cleaner of the embodiment described above. When the motor blower 322 is actuated to make the pressure in the dust chamber 321 negative, dust is sucked in together with air from the suction chamber 356 of the suction nozzle 350, and the dust and air are sucked into the dust chamber 321 of the body 320 through the suction pipe 360.

When the motor blower 322 is actuated, on the other hand, the air in the dust chamber 321 is discharged into the exhaust chamber 323. The air discharged into the exhaust chamber 323 circulates into the suction chamber 356 through the exhaust hose 333, exhaust pipe section 336, exhaust pipe 341, outer pipe 352 of the suction nozzle 350, space section 357, and nozzle holes 358. Thus, the air sucked in from the suction chamber 356 circulates, that is, the air sucked in from the suction chamber 356 of the suction nozzle 350 is never discharged to the outside.

Further, the lip 360 is formed on the rear part of the suction nozzle 350, the nozzle holes 358 extend substantially horizontally, and the gap between the front part of the suction nozzle 350 and the floor surface is wide. Accordingly, the suction nozzle 350 can be prevented from forcing out dust in front of it as it is moved forward to collect the dust. Moreover, air cannot be blown off from the suction chamber 356 to the outside of the suction nozzle 350, so that the dust cannot be scattered.

Furthermore, the circulating blast blown off through the nozzle holes 358 flows along the floor surface (object of cleaning), so that the force to separate dust that adheres to the fibers of tatami mats or a carpet increases, thus improving the effect of dust collection. In consequence, load on the drive motor can be lightened.

According to the present embodiment, moreover, the lip 360 may be provided on the front edge portion in which the nozzle holes 358 are arranged. In this case, the lip is formed having a notch of a suitable size for the passage of dust.

According to this embodiment, the construction is simple, and the circulating air can be securely prevented from leaking out, as mentioned before.

Referring now to FIGS. 17 to 23, there will be described a fourth embodiment of the present invention. This embodiment is applicable to a so-called "pickax" or a tubular suction nozzle that is used to clean narrow areas.

The suction port of the suction nozzle of this type has so small a diameter that it allows the circulating air to leak out easily, as mentioned before.

Figure 17:
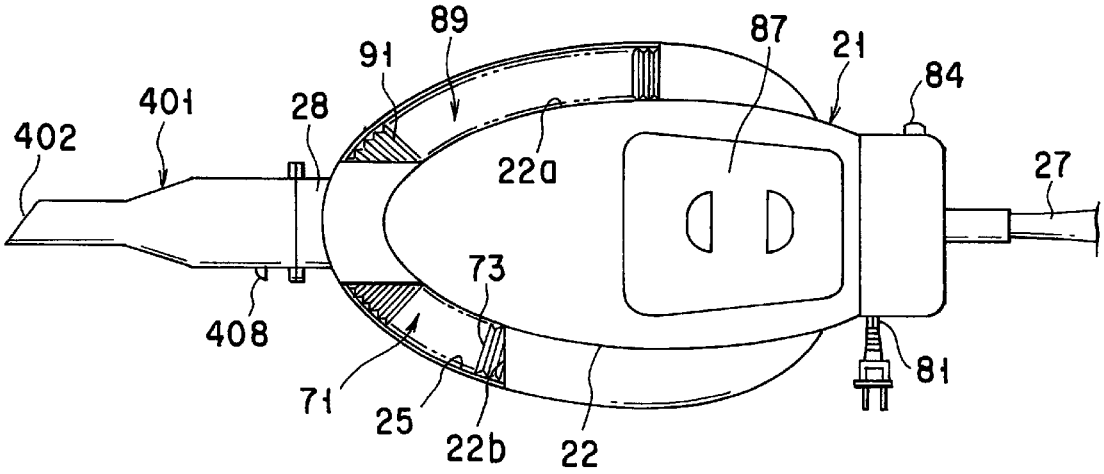
FIG. 17 is a plan view showing the general configuration of an upright air-circulating vacuum cleaner fitted with a sucker according to a fourth embodiment.
Figure 18:
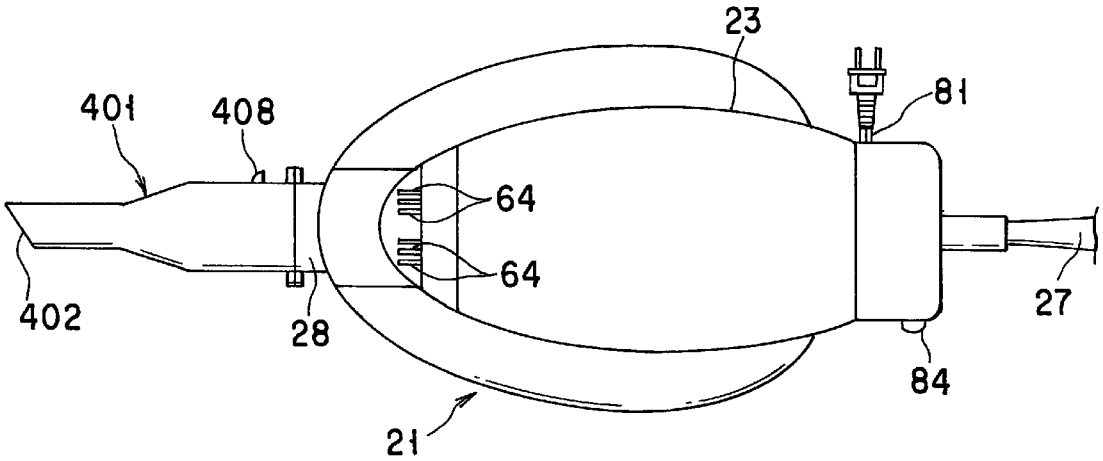
FIG. 18 is a rear view showing the general configuration of the vacuum cleaner shown in FIG. 17.
Figure 19:
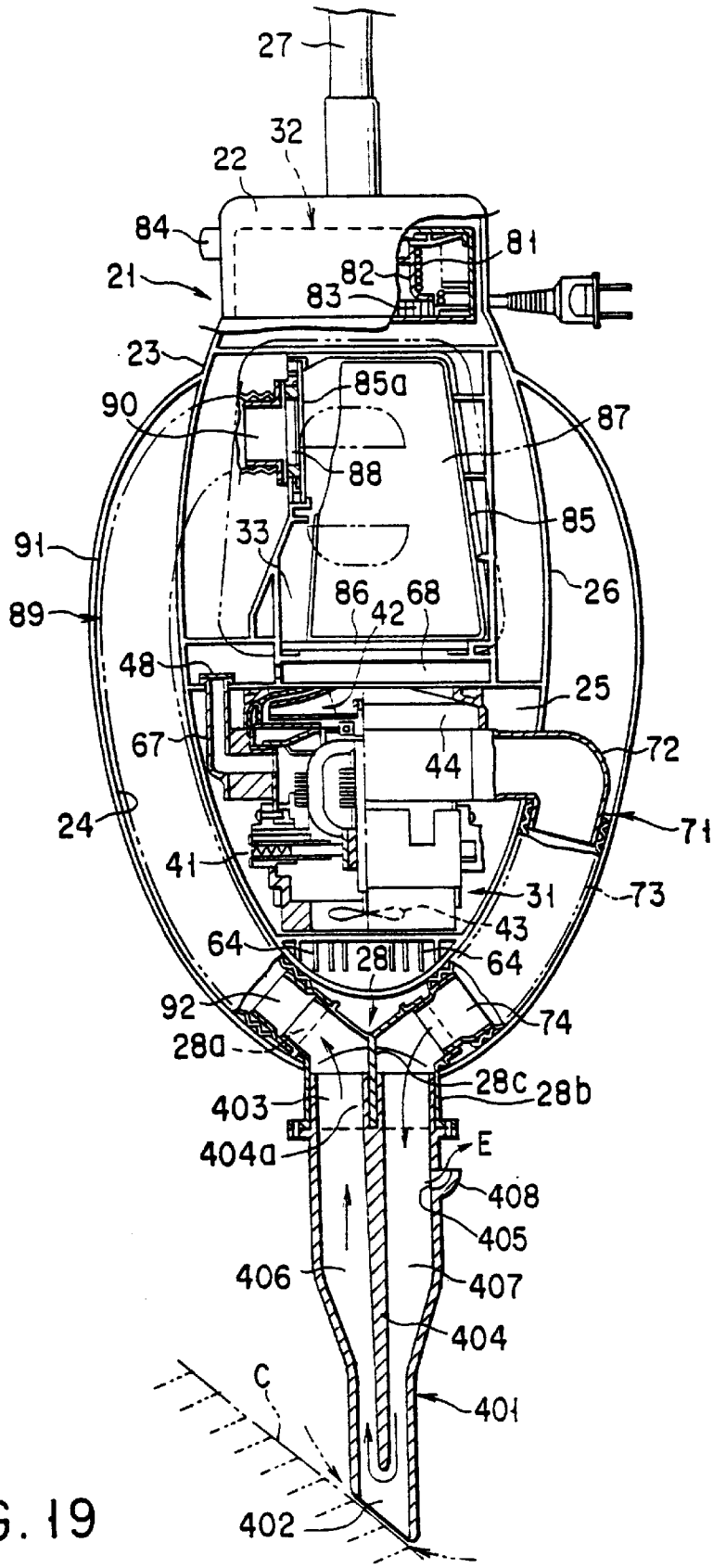
FIG. 19 is a cutaway plan view of the vacuum cleaner shown in FIG. 17, with its upper casing removed.
Figure 20:
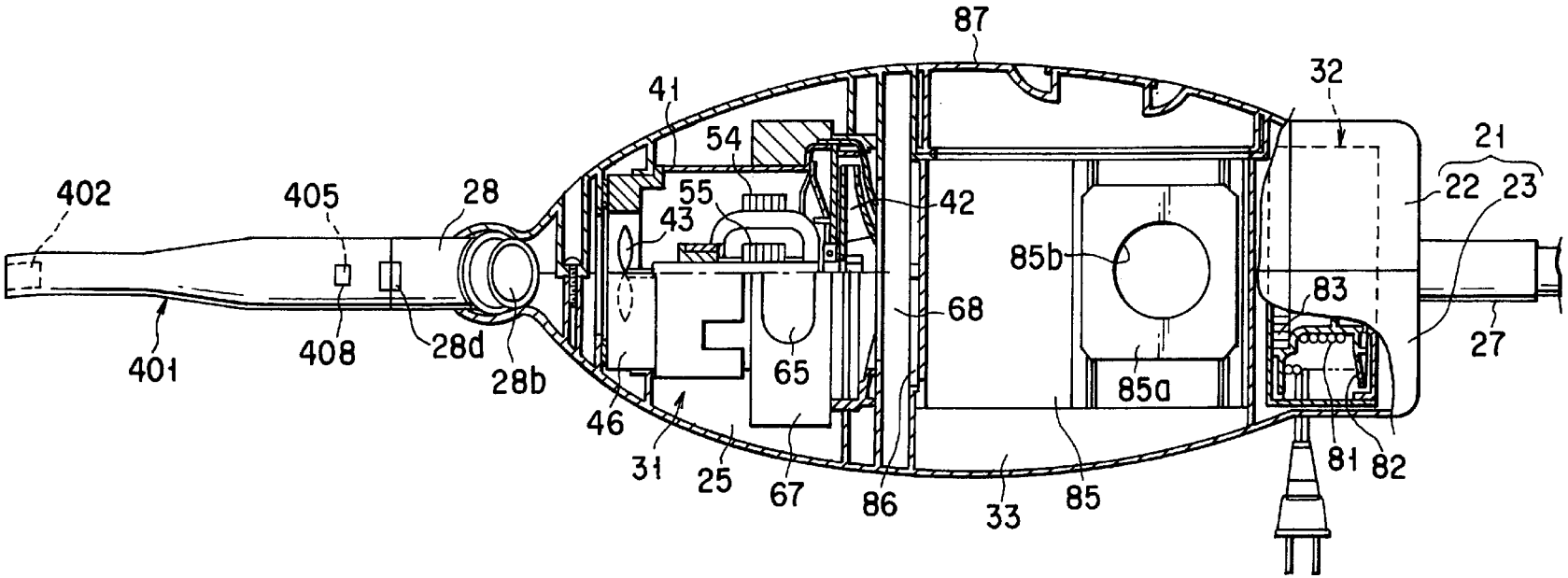
FIG. 20 is a side profile showing the general configuration of the vacuum cleaner shown in FIG. 17.
Figure 23B:
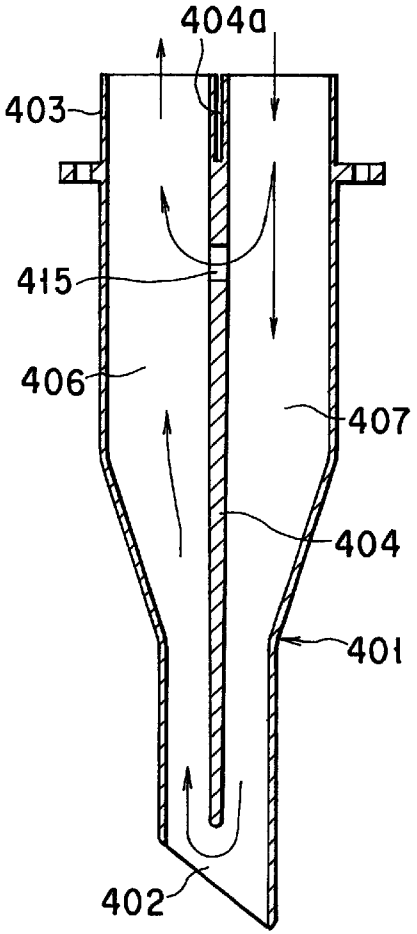
FIG. 23B is a sectional view showing the configuration of another suction nozzle of the fourth embodiment.
Figure 23A:
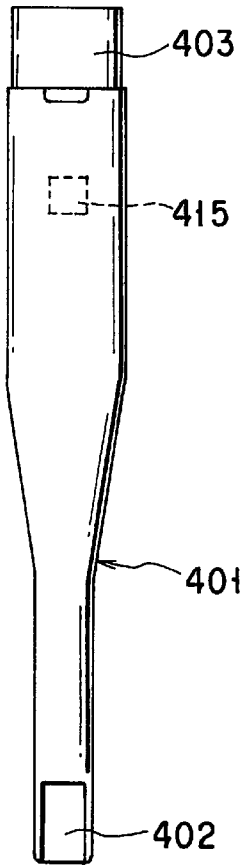
FIG. 23A is a side view showing a configuration of another suction nozzle of the fourth embodiment.

A vacuum cleaner of this embodiment is of a so-called upright type such that its body and the suction nozzle are connected directly to each other. The vacuum cleaner body according to this embodiment is constructed in the same manner as the one according to the first embodiment described above. In FIGS. 17 and 23, like numerals refer to portions that have their respective counterparts in the first embodiment, and a repeated description is omitted.

According to this embodiment, the interconnector pipe 28 of the cleaner body 21 is removably connected with the aforementioned suction nozzle (not shown) of a so-called floor-brush type, which is normally attached to an air-circulating vacuum cleaner.

If necessary for cleaning operation, the interconnector pipe 28 is fitted with a pickax-shaped suction nozzle 401 (illustrated) in place of the aforesaid floor-brush-type suction nozzle. This removable suction nozzle 401, which is suited for cleaning in a narrow place, for example, is formed of a plastic pipe, and includes a suction port 402 movable along the to-be-cleaned surface C, connecting end portion 403, partition wall 404, and exhaust opening 405 as leaking means.

The suction port 402 opens obliquely in the distal end of the suction nozzle 401. The connecting end portion 403 is formed of the proximal end portion of the suction nozzle 401 on the side opposite from the suction port 402. The suction nozzle 401 can be attached to the interconnector pipe 28 by removably fitting the end portion 403 into the interconnector pipe 28. By pulling the suction nozzle 401 toward the suction port 402, moreover, the engagement can be canceled so that the suction nozzle 401 is disengaged from the interconnector pipe 28.

Figure 21B:
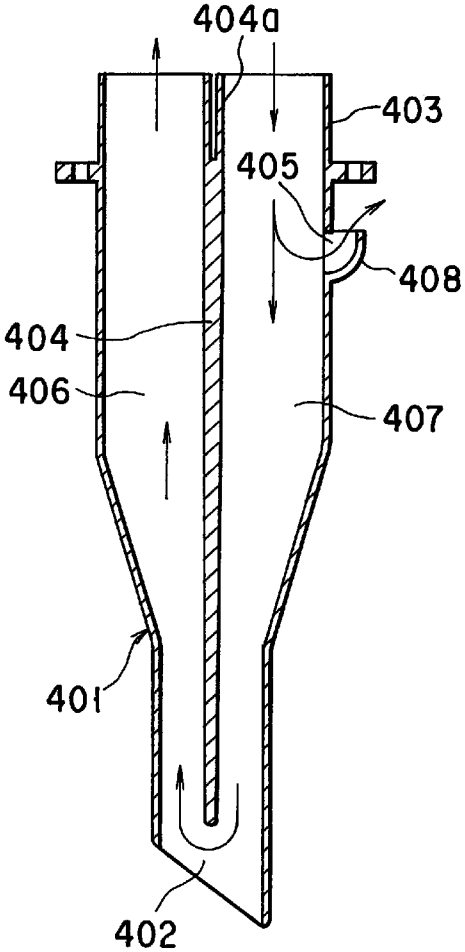
FIG. 21B is a side view showing the configuration of the suction nozzle according to the fourth embodiment.
Figure 21A:
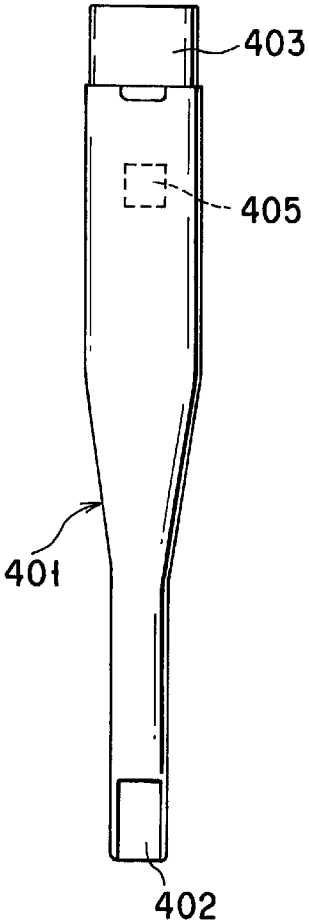
FIG. 21A is a side view showing a configuration of the suction nozzle according to the fourth embodiment.

That portion of the suction nozzle 401 near the suction port 402 is thinner than the portion near the connecting end portion 402, so that the suction nozzle 401 can be easily inserted into a narrow place to be cleaned. The partition wall 404 axially extends from the suction port 402 to the connecting end portion 403 in the suction nozzle 401 so as to halve the interior of the nozzle 401. With use of the partition wall 404, the inside of the suction nozzle 401 is formed of a suction air passage 406 and an exhaust air passage 407 that are divided from each other. The partition wall 404 has a length shorter than the overall length of the suction nozzle 401, and its lower end does not reach the oblique suction port 402, so that the two air passages 406 and 407 communicate with each other at the suction port 402. As shown in FIG. 21(B), the partition wall 404 has a fitting groove 404*a* in its portion on the side of the connecting end portion 403. When the connecting end portion 403 is fitted in the interconnector pipe 28, it is removably fitted in the diaphragm 28*c* of the pipe 28, whereby the state of connection of the suction nozzle 401 to the interconnector pipe 28 can be stabilized, and the two air passages 406 and 407 can be divided securely.

The exhaust opening 405 is formed in the outer peripheral wall of the suction nozzle 401 so as to be located in a position at a distance from the suction port 402, and preferably closer to the connecting end portion 403. The opening 405 connects the exhaust air passage 407 to the outside of the suction nozzle 401.

Besides, the exhaust opening 405 is provided in a manner such that air that leaks therefrom into the atmosphere cannot be blown against the to-be-cleaned surface C. According to this embodiment, therefore, the exhaust opening 405 is located in a selected position closer to the connecting end portion 403, as mentioned before. Further, the exhaust opening 405 is provided in an upper wall portion such that it never faces the to-be-cleaned surface C when the suction port 402 is in contact with the to-be-cleaned surface C. In order to enhance the effect to prevent blowing against the surface, furthermore, a guide 408 is provided near the exhaust opening 405. In the case where the guide 408 is provided in this manner, the exhaust opening 405 may be provided in any position without being limited to the aforesaid location.

The guide 408 may be designed to project at right angles to the aforesaid outer peripheral wall from under the exhaust opening 405. In a preferred example, however, the guide 408 is provided having a curved surface such that it extends upward to be downwardly convex from the lower edge of the exhaust opening 405, both sides of the guide 408 being continuously closed by the outer peripheral wall. Thus constructed, the guide 408 can guide air that is leaked from the exhaust opening 405 along the curved surface downward, that is, in the upward direction to go away from the to-be-cleaned surface C.

The upright vacuum cleaner fitted with the suction nozzle 401 having the construction described above is used in cleaning in a manner such that the handle 27 is held with the pulled-out feeder cord 81 from its cord reel 32 connected to the power supply, the motor blower 31 is operated as the cleaner body 21 is moved, the whole cleaner is tilted to allow the suction nozzle 401 to be inserted into a narrow place, and the tilted suction port 402 is moved along the to-be-cleaned surface C in the narrow place.

In this cleaning operation, the air fan 42 and the cooling fan 43 of the motor blower 31 are rotated simultaneously. Accordingly, air that contains dust is sucked in through the suction port 402 of the suction nozzle 401 by a sucking action that is caused as the air fan 42 rotates. This air is delivered to the first interconnector pipe section 28*a* of the interconnector pipe 28 through the suction air passage 406. Thereafter, the air is sucked into the filter 85 in the dust chamber 33 through the internal suction air passage 89. Since the air sucked in along this course of suction passes through the filter 85, dust in the air is seized by the filter 85 in the meantime.

The air run through the filter 85 and the filter 86 just behind it flows through the suction gap 68 just behind the filter 86, and is sucked into the air fan 42 through the blast inlet 44*a* of the motor blower 31. The air is discharged from the outlet of the air fan 42 after flowing along the air blades thereof. The discharged air passes through the exhaust aperture 60, and is discharged from electric motor section 41 through the exhaust port 65 of the exhaust nozzle 47.

The air discharged in this manner, that is, exhaust gas from the motor blower 31, is discharged into the second interconnector pipe section 28*b* of the interconnector pipe 28 after passing through the internal exhaust air passage 71, so that the exhaust gas is returned to the suction port 402 through the exhaust air passage 407 of the suction nozzle 401. At the same time, the exhaust gas, returned to the suction port 406 in this manner, is recovered and circulated in the aforesaid course of suction that includes the suction air passage 406, which communicates with the suction port 402, as an inlet. As the air is thus circulated, the dust and the like on the to-be-cleaned surface C in a narrow place are also recovered in the course of suction. The flow of air in the suction nozzle 401 is indicated by solid-line arrows in FIGS. 19 and 21(B).

Since most of the exhaust gas is circulated without being discharged to the outside, the dust and the like cannot be blown off to the outside by the exhaust gas. Moreover, the discharge of operating sounds of the motor blower 31 that propagate in the exhaust gas, and more specifically, blowing sounds produced by the air fan 42, is so small that noises produced during use can be reduced substantially. Thus, this vacuum cleaner is suited for use in a silent environment, such as in a hospital or in the night. Furthermore, the suction nozzle 401 is attracted to the to-be-cleaned surface C less frequently, so that the suction nozzle 401 can be moved more easily.

Since the cooling fan 43 is rotated simultaneously during cleaning operation, the outside air is sucked in correspondingly from outside the cleaner body 21 through the cooling air intake port 64. This outside air subjects the stator 54 and the armature 55 in the motor frame 53 to air-cooling as it circulates in the motor frame 53, and is discharged through the cooling exhaust port 66. Thereafter, the air is sucked into the motor blower 31 through the conduit 67 and the suction gap 68.

If the quantity of dust in the filter 85 is so small that the air passage resistance in the filter 85 is low when the outside air is sucked in the aforesaid manner, the distal end opening of the conduit 67 is closed by the cooling valve 48, so that a very small quantity of cooling outside air that passes through the orifice 48*a* of the cooling valve 48 is sucked into the motor blower 31. In this state, the cooling fan 43 is cooled mainly by air that is sucked into the motor blower 31 via the dust chamber 33, while the electric motor section 41 is cooled by the cooling outside air that flows in the motor frame 53.

If the negative pressure in the dust chamber 33 is raised as the air passage resistance in the filter 85 increases with the increase of the quantity of dust in the filter 85, the negative pressure in the suction gap 68 is also raised. Therefore, the cooling valve 48 is moved to a position such that the distal end of the conduit 67 is opened. Accordingly, the cooling outside air is sucked in large quantities into the motor blower 31. As the outside air is introduced in this manner, the electric motor section 41 and the air fan 42 of the motor blower 31 are mainly cooled. Since the introduction of the cooling outside air is thus controlled in accordance with the degree of accumulation of dust in the filter 85, the temperature of the motor blower 31 can be restrained from increasing without regard to the quantity of dust in the filter 85.

Since the suction nozzle 401 has the exhaust opening 405 that connects the atmosphere and the exhaust air passage, some of the air that is returned to the suction port 402 via the exhaust air passage 407 is discharged into the atmosphere through the exhaust opening 405 during the aforementioned cleaning operation. The suction nozzle 401 itself is in the form of a relatively thin rod, and besides, has a construction such that its portion on the side of the suction port 402 is further thinned so that air that reaches the suction port 402 tends to increase its force. In spite of this, therefore, the air that is returned to the suction port 402 is reduced in quantity and in vigor as some of the air is leaked into the atmosphere through the exhaust opening 405. Thus, the pressure of the air (exhaust gas) that is returned to the suction port 402 can be made lower than the suction pressure of the suction air passage 406 that acts on the suction port 402.

Since the pressure difference in the suction port 402 can be secured in this manner, the air returned to the suction port 402 can be securely sucked into the suction air passage 406, and at the same time, some of the air can be prevented from being blown off around the suction port 402 without being sucked into the suction air passage 406. Thus, dust on the to-be-cleaned surface C can be securely sucked in and cleared accompanying the aforementioned air circulation.

Further, the air that is leaked through the exhaust opening 405 due to the aforesaid pressure difference is discharged in the direction to move away from the to-be-cleaned surface C, guided by the guide 408, immediately after the leakage, so that air E (see FIG. 19) that leaks out through the exhaust opening 405 cannot be blown against the to-be-cleaned surface C. Accordingly, there is no possibility of the dust on the to-be-cleaned surface C being blown away by the aforesaid air discharged into the atmosphere and hindering the cleaning, so that the dust on the to-be-cleaned surface C can be securely sucked in and cleared.

Figure 22:
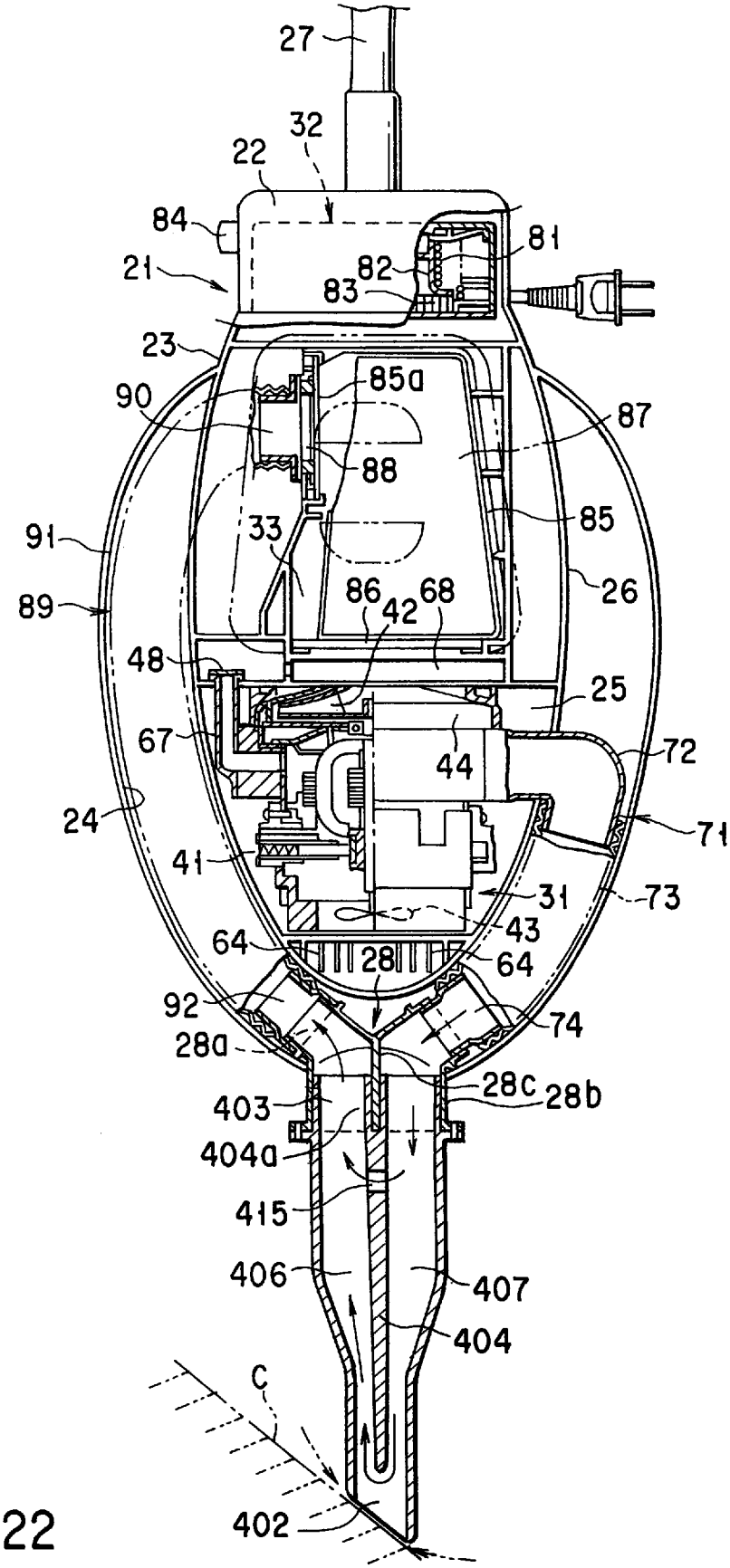
FIG. 22 is a cutaway plan view showing an upright air-circulating vacuum cleaner fitted with another suction nozzle according to the fourth embodiment, with its upper casing removed.

FIGS. 22 and 23 show another modification of the suction nozzle according to the fourth embodiment. This modification is constructed basically in the same manner as the aforesaid one. In FIGS. 22 and 23, like numerals refer to corresponding portions, and a repeated description is omitted. The following is a description of different arrangements only.

This modification is leaking means for reducing the quantity and force of air to be returned to the suction port 402. It is provided in place of the aforesaid exhaust opening that forms the aforesaid leaking means.

More specifically, the partition wall 404 is provided with a bypass aperture 415 for use as leaking means for leaking air from the suction air passage 406 into the exhaust air passage 407. Preferably, the bypass aperture 415 is located close to the connecting end portion 403 lest it influence a current of air sucked in through the suction port 402. Moreover, the opening area of the bypass aperture 415 is adjusted to ½ or less of the cross-sectional area (sectional area across the bypass aperture 415 and along a direction perpendicular to the axial direction of the suction nozzle 401) of the suction air passage 406. This adjustment is an effective process for keeping the dust suction performance of the suction port 402 at a practically necessary level. Based on an experimental result, it was ascertained that if the aforesaid area ratio is ½ or more, the flow of air that leaks through the exhaust air passage 407 into the suction air passage 406 is so high that the current of air returned to the suction port 402 lessens considerably to lower the dust suction performance. Other components including ones that are not shown are constructed in the same manner as their counterparts mentioned before.

In the embodiment shown in FIG. 22, some of the air returned to the suction port 402 through the exhaust air passage 407 is shunted to the suction air passage 406 through the bypass aperture 415. In this case, air can be leaked very easily from the exhaust air passage 407 to the suction air passage 406, aided by the force of the air that flows through the suction air passage 406.

The suction nozzle 401 itself is in the form of a relatively thin rod, and besides, has a construction such that its portion on the side of the suction port 402 is further thinned so that air that reaches the suction port 402 tends to increase its force. In spite of this, the air that is returned to the suction port 402 is reduced in quantity and in vigor due to the aforesaid leakage of the air. Thus, the pressure of the air that is returned to the suction port 402 can be made lower than the suction pressure of the suction air passage 406 that acts on the suction port 402.

Accordingly, the air returned to the suction port 402 can be securely sucked into the suction air passage 406, and at the same time, some of air to be recovered can be prevented from being blown off around the suction port 402 without being sucked into the suction air passage 406. Thus, dust on the to-be-cleaned surface C can be securely sucked in and cleared accompanying the aforementioned air circulation via the suction nozzle 401.

According to this modification, moreover, the air that leaks from the bypass aperture 415 cannot be discharged to the outside of suction nozzle 401. Accordingly, there is no possibility of the air blowing away the dust on the to-be-cleaned surface C or blowing against a user's feet or documents on a desk or the like, thereby scattering the documents. Further, the bypass aperture 415 that forms the leaking means cannot be viewed, so that the external appearance of the suction nozzle 401 can be improved.

Moreover, this embodiment is not applied restrictedly to the illustrated upright vacuum cleaner, and may be also applied to vacuum cleaners of the canister type, handy type, and various other types. Accordingly, the suction nozzle 401 may be a suction nozzle 401 that is connected to the cleaner body 21 by means of a transit pipe, such as an extension pipe that includes an external suction air passage and an external exhaust air passage, or an air hose, and communicates with the motor blower 31.

In the case where the outer peripheral wall of the suction nozzle according to this embodiment is provided with the exhaust opening 405 for use as leaking means, the opening 405 may be located astride the partition wall 404, thereby connecting the two air passages 406 and 407. In this case, some of the air that leaks out of the exhaust air passage 407 through the exhaust opening 405, along with the outside air, can be sucked into the suction air passage 406 and circulated therein, so that the temperature of the circulating air can be lowered.

Further, this embodiment is not applied restrictedly to the so-called "pickax"-shaped sucker that is suited for cleaning in a narrow place, and may be also applied to a so-called "circular brush" or a pipe-shaped sucker that is attached to the motor blower for internal connection when it is required by the cleaning operation.

Referring now to FIGS. 24 to 31, there will be described a fifth embodiment of the present invention. According to this embodiment, leakage of air is prevented by discharging part of an exhaust blast from the motor blower to the outside. This arrangement is suited for a suction nozzle of the rotary-brush type.

Figure 24:
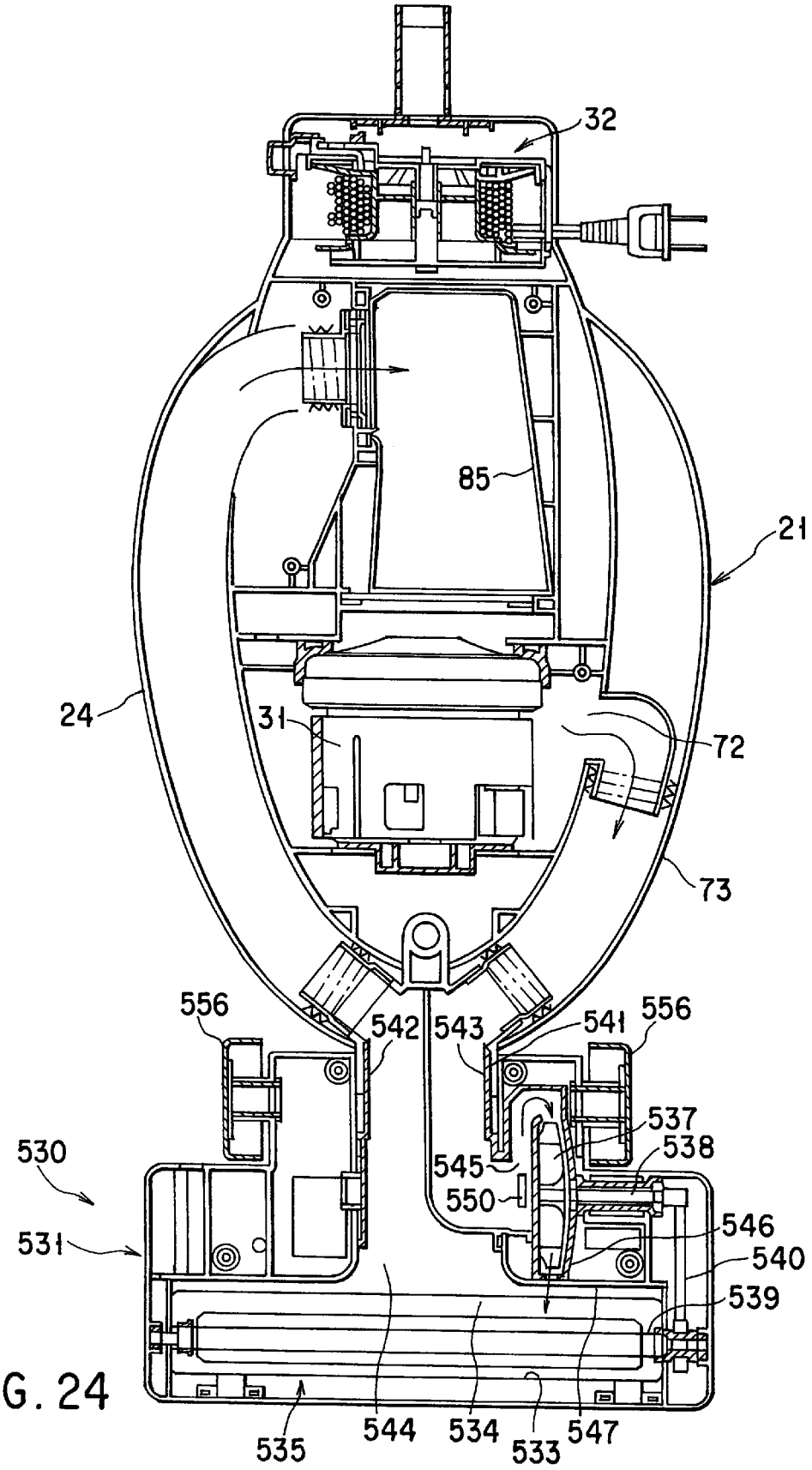
FIG. 24 is a plan view, partially in section, showing a vacuum cleaner of a fifth embodiment with its upper casing removed.

In FIG. 24, 20 denotes a vacuum cleaner that comprises a cleaner body 21 and a suction nozzle 530. The cleaner body 21 is constructed in the same manner as the first embodiment mentioned before. In FIG. 24, like numerals refer to portions that have their respective counterparts in the first embodiment, and a repeated description is omitted.

Figure 25:
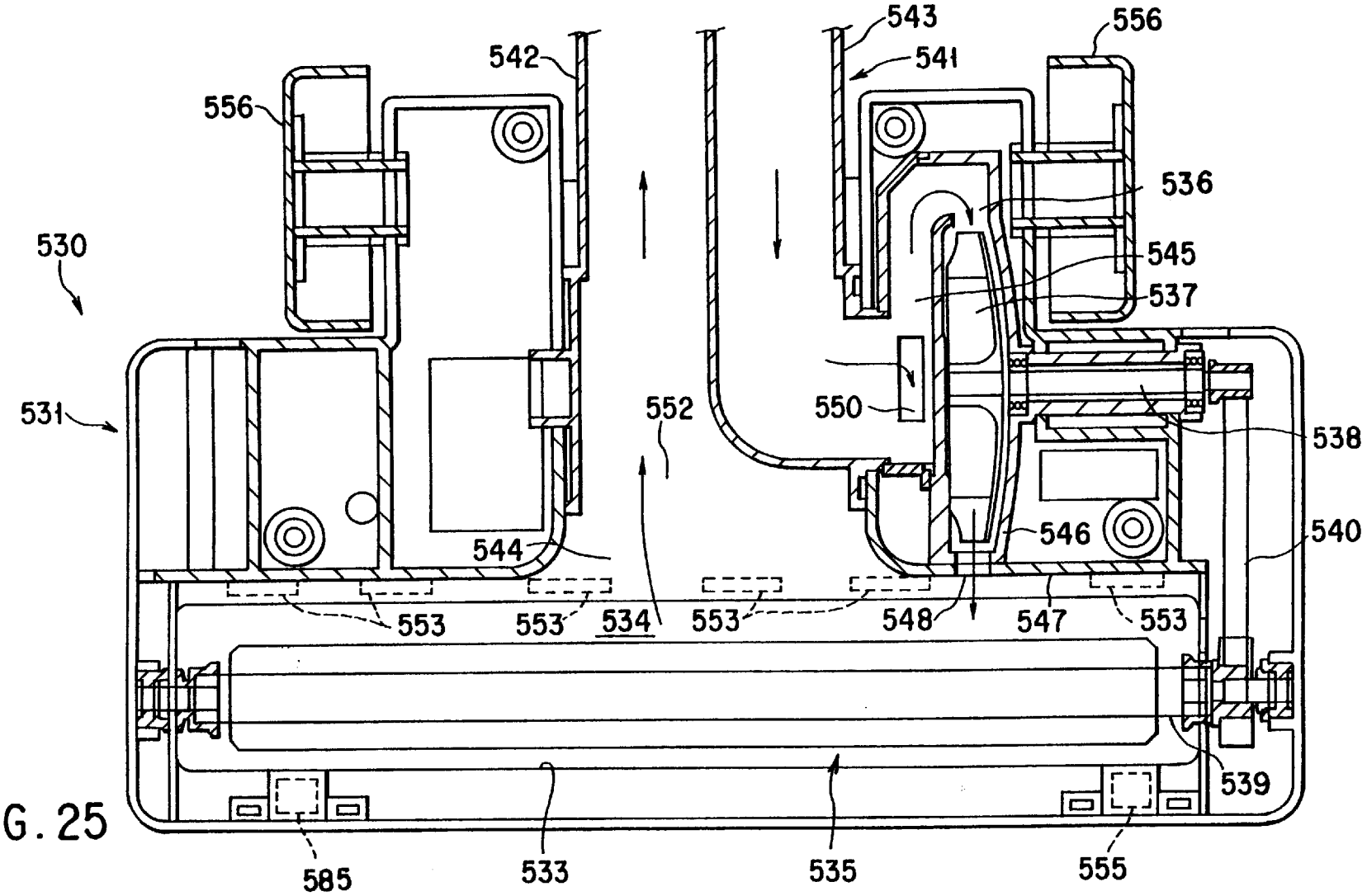
FIG. 25 is a plan sectional view of a suction nozzle of the fifth embodiment.
Figure 26:
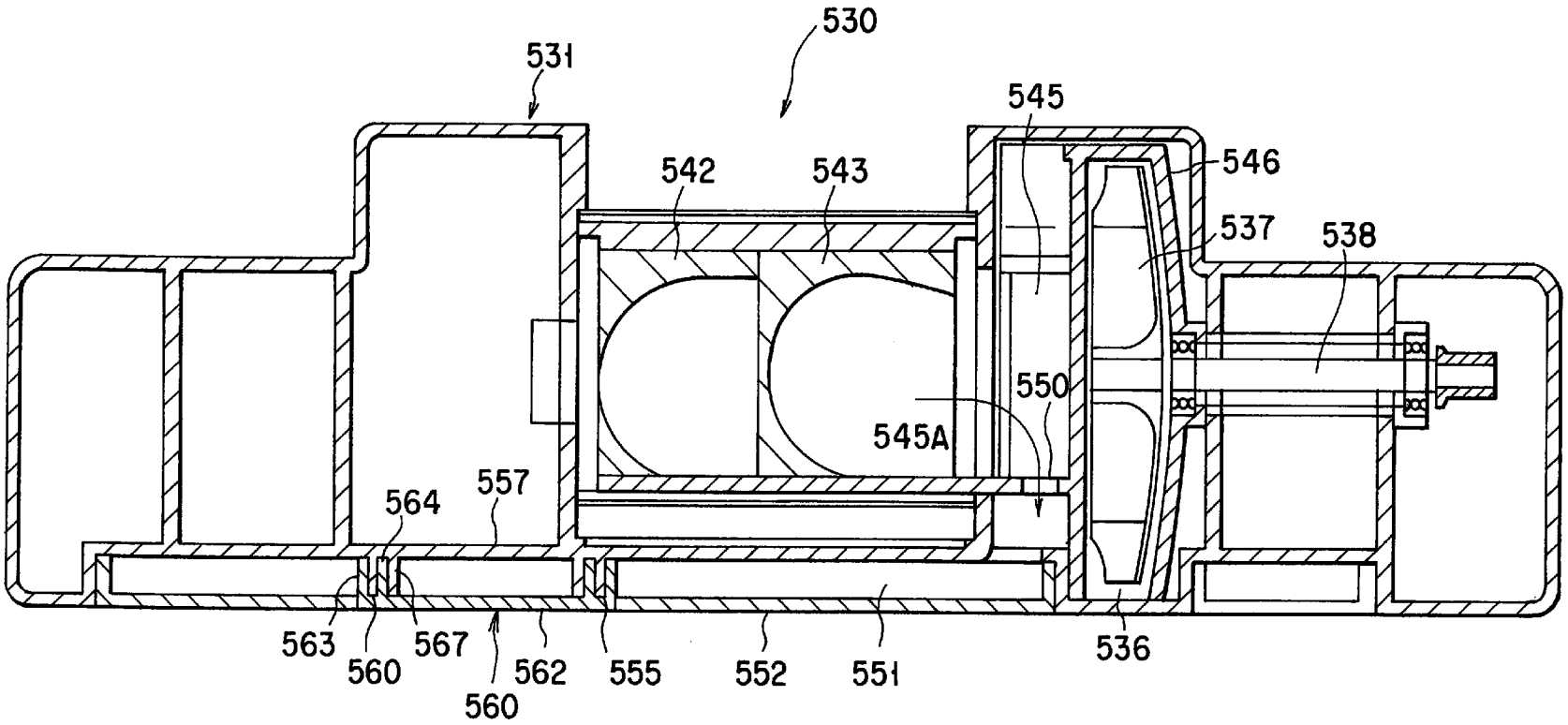
FIG. 26 is a longitudinal sectional view of the suction nozzle of the fifth embodiment.
Figure 27:
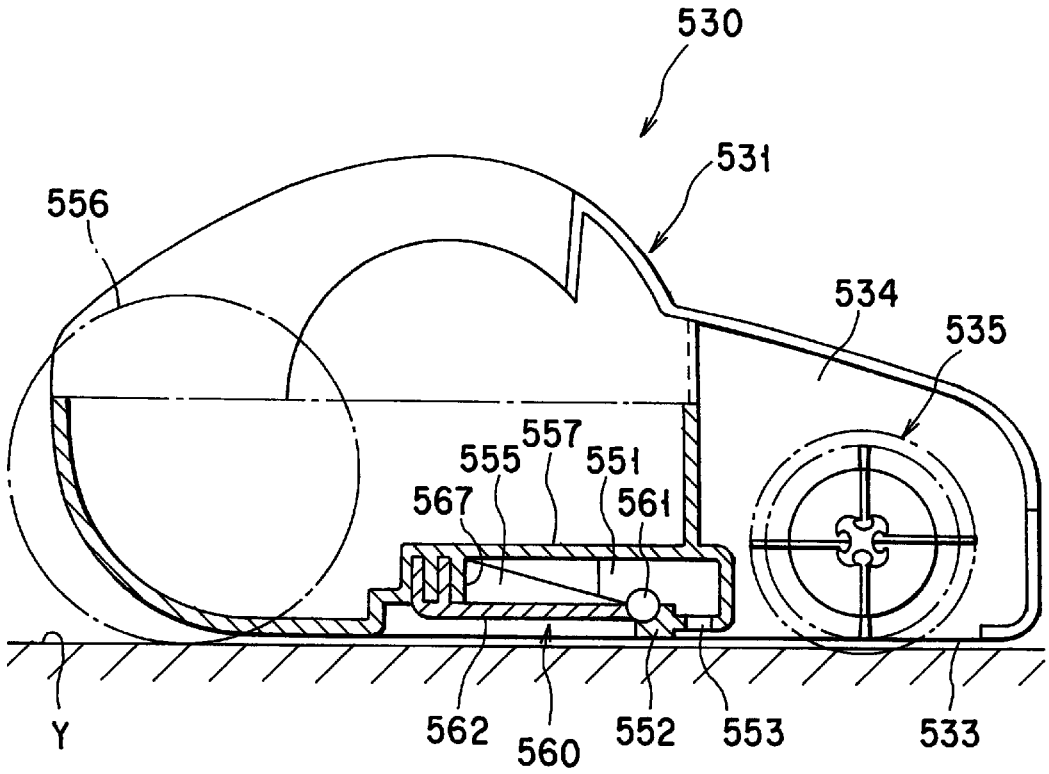
FIG. 27 is a cross-sectional view of the suction nozzle of the fifth embodiment.

As shown in FIGS. 25 to 27, the suction nozzle 530 is provided with a suction nozzle body 531. Formed in front of the suction nozzle body 531 is a suction chamber 534 having a suction opening 533, which extends from side to side along a base. A cleaning rotor 535 is located for rotation in the suction chamber 534. On the right-hand side of the region behind the suction chamber 534, a turbine chamber 536 is defined by a partition wall 546, and a turbine 537 is located for rotation in the turbine chamber 536. An endless belt 540 is passed around a rotating shaft 538 of the turbine 537 and a rotating shaft 539 of the cleaning rotor 535. The cleaning rotor 535 is designed to rotate as the turbine 537 rotates.

At the back of the suction chamber 534, moreover, a connecting pipe member 541 is connected for rocking motion in the vertical direction (in FIG. 26). The connecting pipe member 541 is composed of a suction connecting pipe 542 and an exhaust connecting pipe 543, the suction connecting pipe 542 and the suction chamber 534 communicating with each other by means of a suction air passage 544 that is formed in the cleaning rotor 535. Further, the exhaust connecting pipe 543 and the turbine chamber 536 communicate with the cleaning rotor 535 by means of an exhaust air passage 545 that is formed in the cleaning rotor 535. The suction connecting pipe 542 communicates with a dust chamber in the cleaner body 21 by means of a suction pipe, while the exhaust connecting pipe 543 communicates with an exhaust chamber in the cleaner body by means of an exhaust pipe.

The partition wall 546 of the turbine chamber 536 and a partition wall 547 that defines the suction chamber 534 are provided with a hole 548, and the turbine chamber 536 and the suction chamber 534 communicate with each other by means of the hole 548. A hole 550 is formed in a bottom wall 545A of the exhaust air passage 545.

An exhaust chamber 551 is defined at a bottom portion behind the suction chamber 534. The exhaust chamber 551 and the exhaust air passage 545 communicate with each other by means of the hole 550. A plurality of nozzle holes 553 for blowing off air toward the floor surface are arranged on the front side of a bottom wall 552 that defines the exhaust chamber 551.

Further, the bottom wall 552 is provided with a rectangular opening 555, and a swingable lid 560 is attached to the opening 555. The area of the opening 555 is considerably greater than the gross area of nozzle holes 553.

Figure 28:
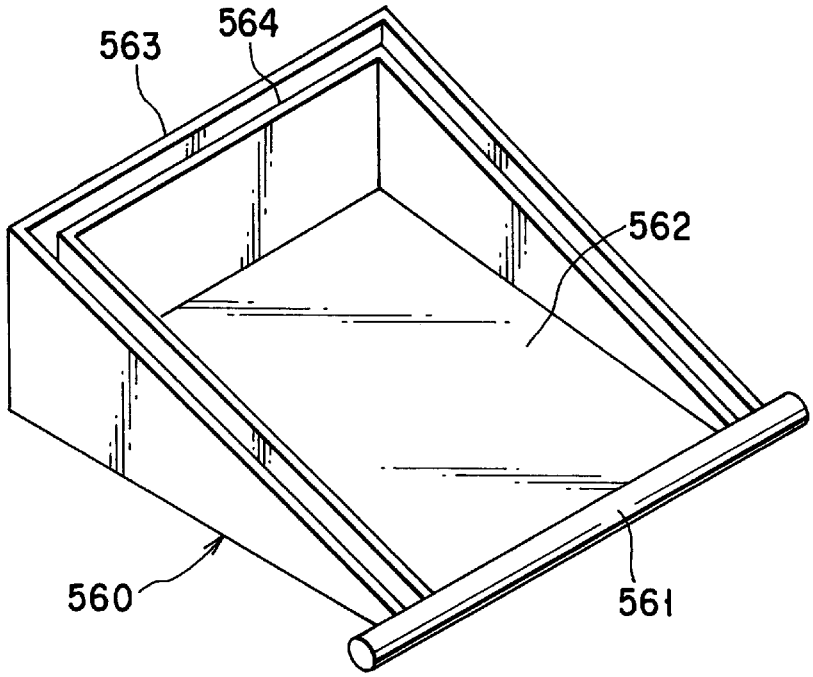
FIG. 28 is a perspective view of a lid of the suction nozzle of the fifth embodiment.

As shown in FIG. 28, the lid 560 includes a shaft 561, which extends from side to side and is rockably mounted on the bottom wall 552 on the front side of the opening 555, a lid plate portion 562 mounted on the shaft 561, and double ribs 563 and 564 that are formed on the three other sides of the lid plate portion 562 than the side on which the shaft 561 is mounted. The lid 560 is taken off or put on as it rocks around the shaft 561. The ribs 563 and 564 are lowered forward (toward the shaft 561) with distance from the rear part, and a fixed gap is formed between the ribs 563 and 564.

Figure 29:
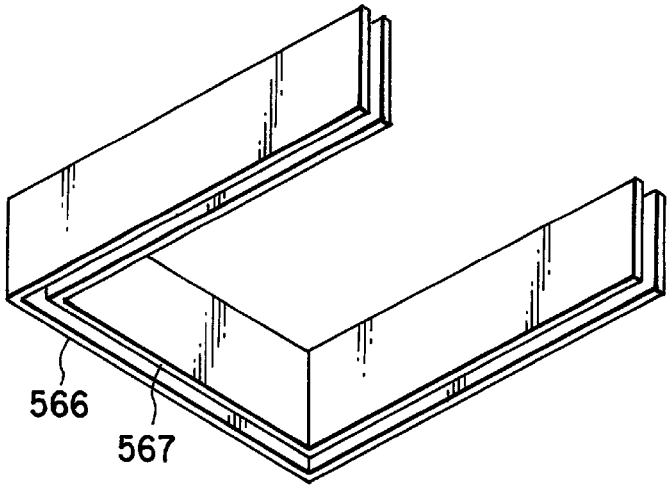
FIG. 29 is a perspective view of a rib portion of the suction nozzle of the fifth embodiment.

As shown in FIG. 29, on the other hand, double ribs 566 and 567 are formed on a top wall 557 of the exhaust chamber 551 that faces the opening 555 of the bottom wall 552, in a position around the opening 555. When the lid 560 is on, the rib 566 is fitted in the gap between the ribs 563 and 564 of the lid 560, and at the same time, engage the inside of the rib 563 and the outside of the rib 564. Further, the rib 567 engages the inside of the rib 564 of the lid 560, so that the opening 555 is closed up tight.

Figure 30:
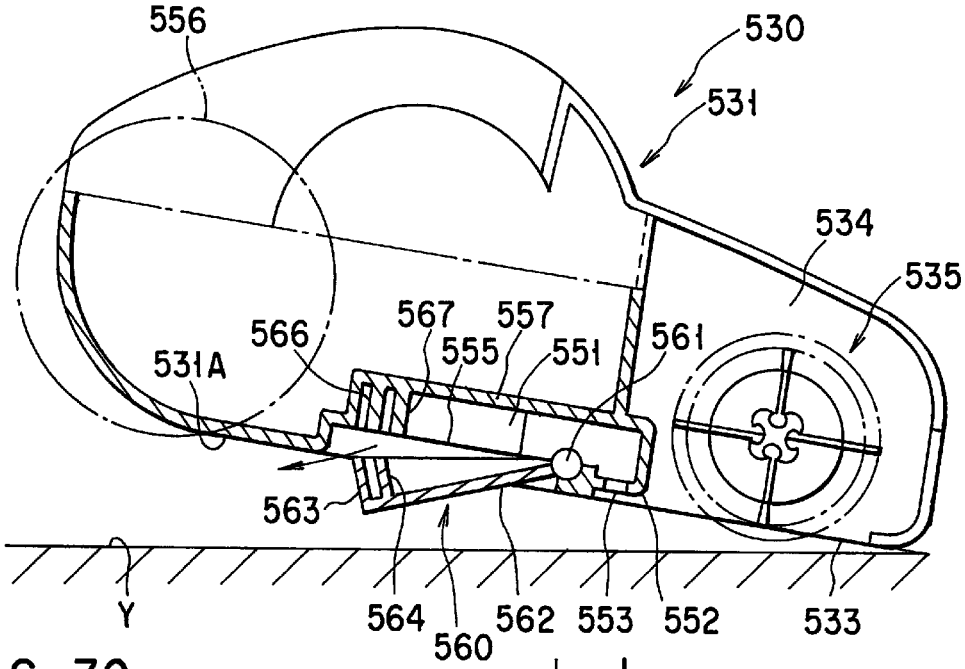
FIG. 30 is a cross-sectional view of the suction nozzle of the fifth embodiment with its lid open.

When the lid 560 rocks around the shaft 561 of the lid 560, as shown in FIG. 30, the ribs 563 and 564 of the lid 560 are disengaged from the ribs 566 and 567, so that the opening 555 is opened. Thereupon, the exhaust blast is discharged rearward along the base portion of the suction nozzle 530 from the opening 555.

Figure 31:
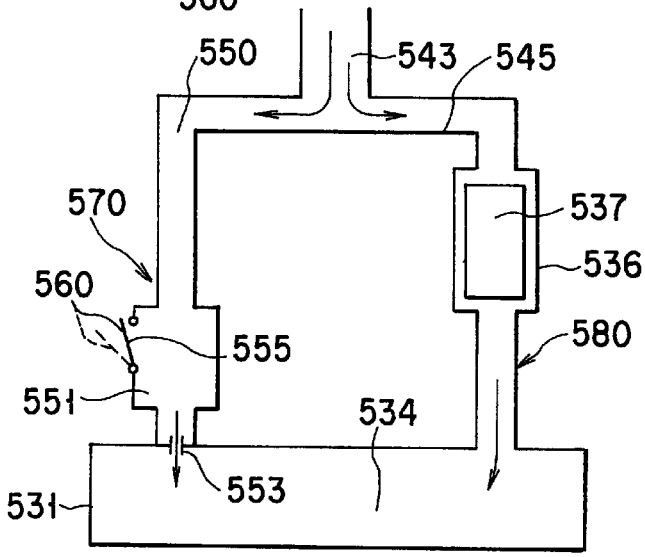
FIG. 31 is a schematic view showing an air passage of the vacuum cleaner of the fifth embodiment.

As shown in the conceptual view of FIG. 31, an interconnector air passage 570 having the exhaust chamber 551 and an interconnector air passage 580 having the turbine chamber 536 are arranged in parallel with each other between the suction chamber 534 and the exhaust pipe 543.

Numeral 585 denotes a pair of rollers on the front side of the suction nozzle body 531, and 556 denotes a pair of rear wheels at the rear part of the suction nozzle body 531.

The following is a description of the operation of the suction nozzle for vacuum cleaner according to the embodiment described above. When the motor blower 31 is actuated to make the pressure in the dust chamber negative, dust is sucked in together with air from the suction chamber 534 of the suction nozzle body 531, and the dust and air are sucked into the dust chamber of the cleaner body 21 through the suction air passage 544, suction connecting pipe 542, and suction pipe.

On the other hand, the air in the dust chamber that is discharged as the motor blower 31 is actuated is discharged into the exhaust chamber. Further, the air discharged into the exhaust chamber is discharged into the exhaust connecting pipe 543 of the suction nozzle body 531 through the exhaust pipe 562. The air discharged into the exhaust connecting pipe 543 is discharged into the turbine chamber 536 through the exhaust air passage 545. Further, the air discharged into the turbine chamber 536 is sucked into the suction chamber 534 through the hole 548 of the partition walls 546 and 547. Then, the turbine 537 is rotated by means of the air discharged into the turbine chamber 536. As the turbine 537 rotates in this manner, the cleaning rotor 535 rakes up dust on a floor surface Y.

Further, the air discharged into the exhaust air passage 545 is discharged into the exhaust chamber 551 through the hole 550 of the bottom wall 545A, and the air discharged into the exhaust chamber 551 is blown off against the floor surface Y through the nozzle holes 553. The dust on the floor surface Y is flung up by the air that is blown off through the nozzle holes 553, and the dust and air are sucked into the suction chamber 534. Then, the dust and air are sucked into the dust chamber in the same manner as aforesaid, and the air is discharged from the dust chamber into the exhaust chamber and circulated.

When the suction nozzle 530 is lifted, as shown in FIG. 30, the lid 560 rocks around the shaft 561, so that the ribs 563 and 564 of the lid 560 are disengaged from the ribs 566 and 567 to allow the opening 555 to open, whereupon the pressure in the exhaust chamber 551 is adjusted to the atmospheric pressure. Accordingly, the speed of ejection of the exhaust blast through the nozzle holes 553 is low. Thus, the dust on the floor surface Y cannot be scattered by the exhaust blast that is blast blown off through the nozzle holes 553 when the suction nozzle 530 is lifted.

Since the lid 560 is rocked in the counter-clockwise direction (in FIG. 30) around the shaft 561 to be taken off, the exhaust blast from the opening 555 is discharged rearward along a base 531A of the suction nozzle body 531. Since the area of the opening 555 is wide, moreover, the speed of ejection of the exhaust blast is so low that the dust on the floor surface Y cannot be scattered. Since the exhaust blast is discharged through the opening 555, furthermore, dust cannot collect on the lid 560, so that there is no possibility of collected dust preventing the lid 560 from being taken off or put on.

Since the pressure in the turbine chamber 536 lowers as the opening 555 is opened, on the other hand, the rotating speed of the turbine 537 lowers, so that the rotating speed of the cleaning rotor 535 lowers. Accordingly, the cleaning rotor 535 is exposed when the suction nozzle 530 is lifted. This is safe, however, since the rotating speed of the cleaning rotor 535 is lowered.

If the floor surface Y is the surface of a carpet or the like, the pile of the carpet causes the lid 560 to close the opening 555, as shown in FIG. 27, though the lid 560 may be left narrowly open, depending on the type of the carpet. However, the exhaust chamber 551 is kept airtight by the double ribs 563, 564, 566 and 567 on the lid 560 and the top wall 557, so that the speed of ejection of the exhaust blast blown off through the nozzle holes 553 can be kept at a given speed, and the rotating speed of the turbine 537 can be also kept at a given speed. In the case where the floor surface Y is the surface of a floor board or the like, the lid 560 is in a half-open state, so that the speed of ejection of the exhaust blast blown off through the nozzle holes 553 lowers. Further, the pressure in the turbine chamber 536 lowers, so that the rotating speed of the turbine 537 lowers.

Thus, in the case of a floor board or the like that requires no raking by means of the cleaning rotor 535, the rotating speed of the turbine 537 lowers, and the speed of ejection of the exhaust blast blown off through the nozzle holes 553 also lowers. In the case of a carpet or the like that requires raking by means of the cleaning rotor 535, the rotating speed of the turbine 537 increases, and the speed of ejection of the exhaust blast blown off through the nozzle holes 553 also increases. In this manner, the rotating speed of the turbine 537 and the speed of ejection of the exhaust blast blown off through the nozzle holes 553 can be adjusted according to the type of the floor surface.

According to the embodiment described above, the opening 555 is provided with the lid 560, so that the opening 555 can be closed securely. However, the lid 560 may be omitted so that the opening 555 can be closed directly by the floor surface Y when the suction nozzle 530 is placed on the floor surface Y. Although the suction nozzle 530 described above is provided with the turbine 537 and the cleaning rotor 535, it is to be understood that the suction nozzle used need not always be provided with the turbine 537 and the cleaning rotor 535.

Although the lid 560 and the top wall 557 are provided individually with the double ribs 563, 564, 566 according to the embodiment described above, moreover, they may be provided with any one rib each.

The present invention is not limited to the embodiments described above, and various changes and modifications may be effected therein without departing from the scope or spirit of the invention.

Industrial Applicability

According to the present invention, as described above, the exhaust blast from the motor blower can be securely prevented from leaking out in the suction nozzle for vacuum cleaner designed to circulate the exhaust blast and in the vacuum cleaner furnished with the same. Accordingly, ambient dust cannot be scattered, so that effective cleaning can be carried out, thus ensuring high industrial applicability.

What is claimed is:

1. A suction nozzle for attachment to a vacuum cleaner, said vacuum cleaner having a motor and capturing dust by providing air sucked in by operation of the motor through a filter, said suction nozzle being movable along a to-be-cleaned surface, the suction nozzle comprising:

a suction port disposed proximate the to-be-cleaned surface, said suction port having at least one nozzle hole opening for sucking in said air, said at least one nozzle hole opening being formed in a part of an inner portion of a vertical wall surface defining an inside space of said suction port and being used to circulate and provide exhaust air from said motor, and air leakage preventing means for preventing discharge of the air provided through said at least one nozzle hole opening from a gap between the suction nozzle and the to-be-cleaned surface, wherein said air leakage preventing means includes a screen portion formed over a whole area of an edge portion around said suction port except the region proximate said at least one nozzle hole opening.

2. The suction nozzle for attachment to a vacuum cleaner according to claim 1, wherein said at least one nozzle hole opening is directed toward an interior portion of another vertical wall surface.

3. The suction nozzle for attachment to a vacuum cleaner according to claim 2, wherein said at least one nozzle hole opening is provided in the interior portion of the other wall surface on a side opposite a connecting pipe mounting region which connects said suction nozzle to said vacuum cleaner.

4. The suction nozzle for attachment to a vacuum cleaner according to claim 1, wherein said air leakage preventing means further comprises a seal roller extending in a direction perpendicular to a moving direction of said suction nozzle and is rotatable when in contact with said to-be-cleaned surface, the seal roller being attached to said suction port so as to substantially cover the full width thereof.

5. The suction nozzle for attachment to a vacuum cleaner according to claim 4, wherein said seal roller is positioned proximate at least a front side of said suction port.

6. The suction nozzle for attachment to a vacuum cleaner according to claim 5, wherein said seal roller further comprises a plurality of ridges and grooves extending in an axial direction on the outer periphery thereof.

7. A vacuum cleaner comprising a cleaner body having a motor blower therein and a suction nozzle according to claim 1.

8. The vacuum cleaner according to claim 7, wherein said vacuum cleaner is of an upright type such that said cleaner body and said suction nozzle are directly connected to each other.

9. The vacuum cleaner according to claim 7, wherein said vacuum cleaner is of a canister type such that said cleaner body and said suction nozzle are connected by means of a flexible hose.

10. A suction nozzle for attachment to a vacuum cleaner, said vacuum cleaner having a motor and capturing dust by providing air sucked in by operation of the motor through a filter, said suction nozzle being movable along a to-be-cleaned surface, the suction nozzle comprising:

a suction port disposed proximate the to-be-cleaned surface, said suction port having at least one nozzle hole opening for sucking in said air, said at least one nozzle hole opening being formed in a part of an inner portion of a vertical wall surface defining an inside space of said suction port and being used to circulate and provide exhaust air from said motor, air leakage preventing means for preventing discharge of the air provided through said at least one nozzle hole opening from a gap between the suction nozzle and the to-be-cleaned surface, and a cleaning rotor having cleaning blades against which the exhaust air from said motor strikes, wherein said air leakage preventing means further comprises a main suction-nozzle section having a suction port through which said cleaning blades are exposed to a bottom wall opposite the to-be-cleaned surface, a main-section exhaust passage having a nozzle hole opening opposite to said cleaning blades and provided in said main suction nozzle section with the nozzle hole opening located on one side of said suction port in the width direction thereof, and a main-section suction passage provided in said main suction nozzle section and having a suction opening facing said nozzle hole opening across said suction port, said nozzle hole opening and said suction opening being arranged so that air provided from said nozzle hole opening and brought to said suction opening via said cleaning blades flows along said to-be-cleaned surface.

11. The suction nozzle for attachment to a vacuum cleaner according to claim 10, wherein a width of a lower-stream-side bottom wall portion situated on a side with respect to a blowing direction of air provided from said nozzle hole opening is greater than the width of an upper-stream-side bottom wall portion situated on a side with respect to the blowing direction with said suction port between the upper- and lower-stream-side bottom wall portions, said nozzle hole opening being located on the side of said upper-stream-side bottom wall portion, and said suction opening being located on the side of said lower-stream-side bottom wall portion.

12. The suction nozzle for attachment to a vacuum cleaner according to claim 11, wherein said nozzle hole opening projects along said to-be-cleaned surface.

13. The suction nozzle for attachment to a vacuum cleaner according to claim 11, wherein at least the lower part of said suction opening is substantially flush with said nozzle hole opening.

14. The suction nozzle for attachment to a vacuum cleaner according to claim 11, wherein said main suction nozzle section contains a blast guide curved along the outer periphery of said cleaning rotor and defining said main-section exhaust air passage portion in conjunction with the inner surface of said main suction nozzle section, the blast guide separating said main-section suction air passage and said main-section exhaust air passage.

15. The suction nozzle for attachment to a vacuum cleaner according to claim 10, wherein said nozzle hole opening projects along said to-be-cleaned surface.

16. The suction nozzle for attachment to a vacuum cleaner according to claim 15, wherein at least the lower part of said suction opening is substantially flush with said nozzle hole opening.

17. The suction nozzle for attachment to a vacuum cleaner according to claim 15, wherein said main suction nozzle section contains a blast guide curved along the outer periphery of said cleaning rotor and defining said main-section exhaust air passage portion in conjunction with the inner surface of said main suction nozzle section, the blast guide separating said main-section suction air passage and said main-section exhaust air passage.

18. The suction nozzle for attachment to a vacuum cleaner according to claim 10, wherein at least the lower part of said suction opening is substantially flush with said nozzle hole opening.

19. The suction nozzle for attachment to a vacuum cleaner according to claim 18, wherein said main suction nozzle section contains a blast guide curved along the outer periphery of said cleaning rotor and defining said main-section exhaust air passage portion in conjunction with the inner surface of said main suction nozzle section, the guide separating said main-section suction air passage and said main-section exhaust air passage.

20. The suction nozzle for attachment to a vacuum cleaner according to claim 10, wherein said main suction-nozzle section comprises a blast guide curved along an outer periphery of said cleaning rotor and defining said main-section exhaust passage in conjunction with the inner surface of said main suction nozzle section, the blast guide separating said main-section suction passage and said main-section exhaust passage.

21. A vacuum cleaner comprising a cleaner body having a motor blower therein and a suction nozzle according to claim 10.

22. A suction nozzle for attachment to a vacuum cleaner, said vacuum cleaner having a motor and capturing dust by providing air sucked in by operation of the motor through a filter, said suction nozzle being movable along a to-be-cleaned surface, the suction nozzle comprising:

a suction port disposed proximate the to-be-cleaned surface, said suction port having at least one nozzle hole opening for sucking in said air, said at least one nozzle hole opening being formed in a part of an inner portion of a vertical wall surface defining an inside space of said suction port and being used to circulate and provide exhaust air from said motor, and air leakage preventing means for preventing discharge of the air provided through said at least one nozzle hole opening from a gap between the suction nozzle and the to-be-cleaned surface, wherein said suction nozzle is cylindrical, and said air leakage preventing means comprises a connecting end portion having said suction port at the distal end thereof and having a proximal end communicating with the motor exhaust side, wherein said suction nozzle further includes a partition wall dividing a suction air passage, extending between the suction port and the connecting end portion and communicating with a suction side of said motor, and an exhaust air passage, communicating with the suction air passage at said suction port and communicating with the exhaust side of said motor, and which further comprises leaking means internally connecting said exhaust air passage to the atmosphere, thereby allowing some of the air flowing through the exhaust air passage to be expelled, and wherein said leaking means further comprises a bypass aperture provided in the partition wall and internally connecting said suction air passage and said exhaust air passage.

23. The suction nozzle for attachment to a vacuum cleaner according to claim 22, wherein said suction port has a planar shape.

24. The suction nozzle for attachment to a vacuum cleaner according to claim 22, wherein said leaking means comprises an exhaust opening for internally connecting said exhaust air passage to the atmosphere, the exhaust opening being distally located with respect to said suction port.

25. The suction nozzle for vacuum cleaner according to claim 22, further comprising means for preventing air leaking out through said exhaust opening from being blown against said to-be-cleaned surface.

26. A vacuum cleaner comprising a cleaner body having a motor blower therein and a suction nozzle according to claim 22.

27. A suction nozzle for attachment to a vacuum cleaner, said vacuum cleaner having a motor and capturing dust by providing air sucked in by operation of the motor through a filter, said suction nozzle being movable along a to-be-cleaned surface, the suction nozzle comprising:

a suction port disposed proximate the to-be-cleaned surface, said suction port having at least one nozzle hole opening for sucking in said air, said at least one nozzle hole opening being formed in a part of an inner portion of a vertical wall surface defining an inside space of said suction port and being used to circulate and provide exhaust air from said motor, air leakage preventing means for preventing discharge of the air provided through said at least one nozzle hole opening from a gap between the suction nozzle and the to-be-cleaned surface, a suction chamber proximate the suction port having a suction opening, a suction air passage communicating with said suction chamber, an exhaust air passage communicating with said suction chamber, and a nozzle hole opening for blowing exhaust air against the to-be-cleaned surface, wherein said air leakage preventing means further comprises an exhaust chamber for introducing the exhaust air from said exhaust air passage and blowing the exhaust air through said nozzle hole opening, said exhaust chamber having in a bottom wall thereof an opening adapted to be closed by the to-be-cleaned surface when said suction nozzle is placed on the to-be-cleaned surface, the opening being designed so that the exhaust air cannot be blown against the to-be-cleaned surface.

28. The suction nozzle for attachment to a vacuum cleaner according to claim 27, which further comprises a swingable lid for closing said opening, the lid being adapted to permit and prevent access to said opening.

29. The suction nozzle for attachment to a vacuum cleaner according to claim 28, wherein either said opening and lid is surrounded by double ribs, and the other is surrounded by a rib interposed between the double ribs.

30. A suction nozzle for attachment to a vacuum cleaner, said vacuum cleaner having a motor and capturing dust by providing air sucked in by operation of the motor through a filter, said suction nozzle being movable along a to-be-cleaned surface, the suction nozzle comprising:

a suction port disposed proximate the to-be-cleaned surface, said suction port having at least one nozzle hole opening for sucking in said air, said at least one nozzle hole opening being formed in a part of an inner portion of a vertical wall surface defining an inside space of said suction port and being used to circulate and provide exhaust air from said motor, air leakage preventing means for preventing discharge of the air provided through said at least one nozzle hole opening from a gap between the suction nozzle and said to-be-cleaned surface, a suction chamber proximate the suction port having a suction opening, a turbine chamber provided in the suction nozzle and communicating with said suction chamber, a cleaning rotor located in said suction chamber, a turbine located in said turbine chamber whose rotation causes the cleaning rotor to rotate, a suction air passage communicating with said suction chamber, and an exhaust air passage communicating with said turbine chamber, said suction air passage and a dust chamber of a cleaner body communicating with each other so that air in the suction chamber can be provided into the dust chamber, an exhaust side of the cleaner body and said exhaust air passage communicating with each other so that air discharged from the exhaust side of the motor can be provided into the turbine chamber to rotate the turbine and so that the air in the turbine chamber can be sucked into the suction chamber, whereby the air is circulated, wherein said air leakage preventing means includes an opening in the base of the suction nozzle, adapted to be closed by the to-be-cleaned surface when said suction nozzle is placed on the to-be-cleaned surface, the opening and said exhaust air passage communicating with each other, the opening being designed so that the exhaust air provided therefrom cannot be blown against the to-be-cleaned surface.

31. The suction nozzle for attachment to a vacuum cleaner according to claim 30, which further comprises a swingable lid for closing said opening, the lid being adapted to permit and prevent access to said opening.

32. The suction nozzle for vacuum cleaner according to claim 31, wherein either said opening and lid is surrounded by double ribs, and the other is surrounded by a rib interposed between the double ribs.

33. A vacuum cleaner comprising a cleaner body having a motor blower therein and a suction nozzle according to claim 30.

34. A suction nozzle for attachment to a vacuum cleaner, said vacuum cleaner having a motor and capturing dust by providing air sucked in by operation of the motor through a filter, said suction nozzle being movable along a to-be-cleaned surface, the suction nozzle comprising:

a suction port disposed proximate the to-be-cleaned surface, said suction port having at least one nozzle hole opening for sucking in said air, said at least one nozzle hole opening being formed in a part of an inner portion of a vertical wall surface defining an inside space of said suction port and being used to circulate and provide exhaust air from said motor, air leakage preventing means for preventing discharge of the air provided through said at least one nozzle hole opening from a gap between the suction nozzle and said to-be-cleaned surface, a suction chamber proximate the suction port having a suction opening in a base of the suction nozzle, a turbine chamber provided in said suction nozzle and communicating with said suction chamber, a cleaning rotor located in said suction chamber, a turbine located in said turbine chamber whose rotation causes the cleaning rotor to rotate, a suction air passage communicating with said suction chamber, an exhaust air passage communicating with said turbine chamber, and a blow-off port for blowing exhaust air against the to-be-cleaned surface, said suction air passage and a dust chamber of a cleaner body communicating with each other so that air in the suction chamber is provided into the dust chamber, an exhaust side of the cleaner body and said exhaust air passage communicating with each other so that air discharged from the exhaust side is provided into the turbine chamber to rotate the turbine and that the air in the turbine chamber is provided into the suction chamber, whereby the air is circulated, wherein said air leakage preventing means includes an exhaust chamber for introducing the exhaust from said exhaust air passage and blowing the exhaust through said blow-off port, said exhaust chamber having in the bottom wall thereof an opening adapted to be closed by the to-be-cleaned surface when said suction nozzle is placed on the to-be-cleaned surface, the opening being designed so that the exhaust air cannot be blown against the to-be-cleaned surface.

35. The suction nozzle for attachment to a vacuum cleaner according to claim 34, which further comprises a swingable lid for closing said opening, the lid being adapted to permit and prevent access to said opening.

36. The suction nozzle for attachment to a vacuum cleaner according to claim 35, wherein either said opening and lid is surrounded by double ribs, and the other is surrounded by a rib interposed between the double ribs.

37. A vacuum cleaner comprising a cleaner body having a motor blower therein and a suction nozzle according to claim 34.

* * * * *

UNITED STATES PATENT AND TRADEMARK OFFICE

CERTIFICATE OF CORRECTION

PATENT NO. : 6,237,188 B1
DATED : May 29, 2001
INVENTOR(S) : Ritsuo Takemoto et al.

It is certified that error appears in the above-identified patent and that said Letters Patent is hereby corrected as shown below:

Title page,
Item [22], PCT Filed, change "Dec. 25, 1999" to -- Dec. 25, 1998 --.

Signed and Sealed this

Fifteenth Day of January, 2002

*Attest:*

*Attesting Officer*

JAMES E. ROGAN
*Director of the United States Patent and Trademark Office*